US005939828A

United States Patent [19]

Matsuzaki et al.

[11] Patent Number: 5,939,828

[45] Date of Patent: Aug. 17, 1999

[54] GAS DISCHARGE DISPLAY PANEL HAVING ADDRESS ELECTRODES LOCATED ON SECOND BARRIER RIBS

[75] Inventors: Eiji Matsuzaki; Nobuyuki Ushifusa, both of Yokohama; Seiichi Tsuchida, Yokosuka; Kazuo Suzuki, Yokohama; Teruo Takai, Isehara; Kyoko Amemiya, Yokohama; Shiyuki Sakaue, Hiratsuka; Fusaji Shoji, Yokohama, all of Japan

[73] Assignee: Hitachi, Ltd., Tokyo, Japan

[21] Appl. No.: 08/906,264

[22] Filed: Aug. 5, 1997

[30] Foreign Application Priority Data

Aug. 6, 1996 [JP] Japan ..... 8-206855

[51] Int. Cl.[6] ..... H01J 17/49; G09G 3/28

[52] U.S. Cl. ..... 313/584; 313/586; 313/587; 313/484; 313/493; 345/60

[58] Field of Search ..... 313/584, 586, 313/587, 484, 493; 345/60

[56] References Cited

U.S. PATENT DOCUMENTS 5,351,144 9/1994 Tanamachi ..... 345/60
5,570,104 10/1996 Hayashi ..... 345/60
5,760,753 6/1998 Hayashi ..... 345/60
5,805,122 9/1998 Bongaerts et al. ..... 345/60
5,818,168 10/1998 Ushifusa et al. ..... 313/582

FOREIGN PATENT DOCUMENTS 0 554 172 A1 8/1993 European Pat. Off. .
0 691 671 A1 1/1996 European Pat. Off. .
1-311541 12/1989 Japan .
4-282534 10/1992 Japan .
5-089785 4/1993 Japan .
7-021929 1/1995 Japan .

OTHER PUBLICATIONS

Flat Panel Display, 1996 (edited by Nikkei Microdevice, 1995) pp. 208–215.

*Primary Examiner*—Sandra O'Shea
*Assistant Examiner*—Ronald E. Delgizzi
*Attorney, Agent, or Firm*—Antonelli, Terry, Stout & Kraus, LLP

[57] ABSTRACT

In order to reduce the address voltage in a gas discharge type display pane, the address electrodes in the display panel are formed on the barrier ribs. Further, a fluorescent layer is coated on the wall surface of the barrier ribs thereby suppressing erroneous light emission or degradation of the fluorescent layer during address discharge.

18 Claims, 25 Drawing Sheets

GAS DISCHARGE DISPLAY PANEL HAVING ADDRESS ELECTRODES LOCATED ON SECOND BARRIER RIBS

BACKGROUND OF THE INVENTION

The present invention concerns a gas discharging type display panel, such as a plasma display panel, and a display device therefor, and, particularly, it relates to a gas discharging type display panel and a display device therefor, which is capable of easily selecting a display cell and which has an improved working life.

Since a gas discharging type display device, such as a plasma display device produces a display by self light emission, its view angle is wide and the display is easy to see. In addition, it has the advantageous feature that it is capable of being prepared as a reduced thickness type device or of attaining a large area screen, and so the application thereof to display devices for information terminal equipment and high quality television receiver sets already has been started. The plasma display is generally classified into a DC driving type and an AC driving type. Of the two types, the AC driving type plasma display attains a high brightness by use of the memory effect of a dielectric layer covering the electrodes and can obtain a practical working life by the formation of a protection layer and the like. As a result, the plasma display has been put to practical use as a multi-purpose video monitor. An example is shown in FIG. 22 and FIG. 23. FIG. 22 is a perspective view illustrating the structure of a plasma display panel which has been put to practical use. In the figure, a front substrate 1 is illustrated as being spaced from a back substrate 2 and a discharging space region 3 for the sake of easy understanding. The front substrate 1 has a structure in which display electrodes 6 made of a transparent conductive material, such as ITO (Indium Tin Oxide) or tin oxide (SnO2), bus electrodes 7 made of a low resistance material, a dielectric layer 8 made of a transparent insulating material and a protection layer 9 made of a material, such as magnesium oxide (MgO), are formed on a front glass substrate 4. The back substrate 2 has a structure in which address electrodes 10, barrier ribs 11 and a fluorescent layer 12 are formed on a back glass substrate 5. Then, a discharging space region 3 is formed between the front substrate 1 and the back substrate 2 by appending the front substrate 1 and the back substrate 2 such that the display electrodes 6 and the address electrodes 10 are substantially perpendicular to each other.

FIGS. 23(*a*) to 23(*c*) are cross sectional views of the gas discharging type display device shown in FIG. 22. FIG. 23(*a*) shows a cross section in parallel with the address electrodes 10, FIG. 23(*b*) shows a cross section taken along line A-B in FIG. 23(*a*) vertical to the address electrodes 10 and FIG. 23(*c*) shows a cross section along line C-D in FIG. 23(*a*) vertical to the address electrodes 10. In the gas discharging type display device illustrated herein, an address discharge is generated by applying a voltage between a pair of display electrodes 6 disposed on the substrate 1 and the address electrodes 10 disposed on the back electrode 2 to select a predetermined cell, and a main discharge is generated by applying an AC voltage (pulse voltage) between the pair of display electrodes 6. Ultraviolet rays generated by the main discharge excite the fluorescent body 12 to emit light, thereby producing a display.

An example of the standard gas discharging type display device illustrated herein is described, for example, in Flat Panel Display, 1996 (edited by Nikkei Microdevice, 1995) from page 208 to page 215.

In the publication described above, an address discharge for selecting the display cell is conducted between the display electrodes 6 disposed on the front substrate 1 and the address electrode 10 disposed on the back substrate 2. In this case, since the distance between the display electrode 6 and the address electrode 10 is as large as about 0.2 mm, an application voltage required for generating an address discharge (referred to as address voltage) is at a high value of 200 V or higher. In the arrangement disclosed in the publication, for lowering the address voltage, a high voltage of about 300 V is applied to an electrode 62 on the side of a common electrode of the display electrode 6 (referred to as an auxiliary discharge) and then an address discharge is generated at a predetermined display cell. That is, the address voltage is set lower by generating an auxiliary discharge in all of the display cells and forming wall discharges on the surface of the protection layer 9 covering the display electrode 6 and the fluorescent layer 12 covering the address electrode 10.

On the other hand, the distance between the display electrodes 6 and the address electrodes 10 may be shortened for lowering the address voltage. However, if the gap between the front substrate and the back substrate is merely narrowed, this is not preferred, since the discharging space is also reduced. Further, if the gap between the front substrate and the back substrate is narrowed, since the fluorescent layer 12 on the address electrode 10 is brought closer to the display electrode 6, excess erroneous emission of the fluorescent layer is increased upon generating of the auxiliary discharge or address discharge at the display electrodes, or degradation of the fluorescent layer by plasma damage is caused.

In addition, the gas discharging display device disclosed in the above-mentioned publication involves the following problems. (1) For generating the auxiliary discharge for forming the wall charges described above, a time is required for forming the wall charges, which shortens the display time and makes it difficult to provide gradation in the display. (2) Since the fluorescent layer 12 is present on the address electrodes 10, the fluorescent layer 12 emits light erroneously upon address discharge. Therefore, the contrast on the display screen is lowered. (3) Since the fluorescent layer 12 is present on the address electrodes 10, the fluorescent layer suffers from plasma (ion) damage due to the address discharge. This causes a shortening of the working life of the gas discharging type display device.

Each of these problems results from the fundamental structure of the gas discharging type display device. That is, these problems are caused due to the arrangement of the address electrodes, barrier ribs and the fluorescent layer as shown in FIG. 22 and FIGS. 23(*a*) to 23(*c*).

Further, in a case of manufacturing this gas discharging display device, a problem exists in a step of forming the barrier ribs 11 on the back substrate 2.

For example, in the barrier rib formation using a thick-film printing process, since thick film printing and drying are repeated over and over, this tends to cause, for example, defects in the dimensional accuracy of a thick film pattern, alignment failure between each of thick film patterns or deformation of a large screen plate. Therefore, the manufacturing process is lengthened and the manufacturing yield is lowered. Further, it is difficult to obtain a refinement to about 0.05 mm using the thick-film printing process, tending to cause more deformation in a larger screen plate. This brings about a difficulty in the refinement and the size-enlargement of a display screen.

Further, for formation of barrier ribs, a photo-burying method, a sand blasting method and a photosensitive paste method have been proposed and are being studied. However, they have the following problems, respectively.

The photo-burying method comprises forming a rib-shaped groove pattern on the back substrate 4, formed with address electrodes 10, by using a light sensitive film and burying a barrier rib layer in the groove pattern. With this method, it is difficult to form a groove pattern having a depth of 0.1 mm or more at a width of about 0.05 mm. In addition, it is an important to assure chemical stability between the barrier rib layer to be buried and the light sensitive film (solution or reaction) and to develop an effective method of burying the barrier rib material.

The sand blasting method comprises forming a barrier rib pattern by a light sensitive film on a barrier rib layer disposed on the back glass substrate 5 formed with address electrodes 10 and removing the barrier rib layer from a region in which the light sensitive film is not present by using sand blasting. Also in this a method, it is necessary to repeat printing and drying for obtaining a thick barrier rib layer, since the thickness of the barrier layer that can be printed in one step is small. Further, there is a requirement for covering the address electrode with other material in order to protect the address electrode 10 against damages which might occur in the sand blasting step. That is, the sand blasting method also involves a problem that the step is lengthened and there is a concern for possible damage to the address electrode, and it is also important to develop a light sensitive film which is inexpensive and has excellent resistance to blasting in order to lower the manufacturing cost of the gas discharging type display device.

The light sensitive paste method comprises forming a barrier rib layer by using a light sensitive barrier rib material and forming barrier ribs by well-known photolithography, such as exposure and development. While this method is a simple process, development of the material has not yet been completed. Therefore, the limit for fabrication and the limit for the lamination are unknown if the thickness is increased. Also for the film forming method, a thick-film forming technology has not yet been established, which is a technique yet to be developed in the future.

As described above, each of the prior art stated above is a technique for forming barrier ribs of different material on the back substrate, so that the manufacturing step is lengthened and it is difficult to obtain a high manufacturing yield.

Further, in the method of forming the barrier ribs described above, barrier ribs are obtained by forming a barrier rib layer on the back substrate formed with the address electrodes and then sintering them. Therefore, since the sintering temperature for the barrier ribs is higher than the distortion point of soda lime glass used for the back glass substrate 5, this also brings about a problem of glass deformation. Further, if the area of the display screen is increased, there may also be a problem of barrier rib shrinkage due to sintering. These problems lower the manufacturing yield of the gas discharging type display device.

SUMMARY OF THE INVENTION

A first object of the present invention is to provide a gas discharging type display panel and a display device capable of lowering the address voltage applied between display electrodes and address electrodes. It is an additional object thereof to provide a gas discharging type display panel and a display device capable of lowering the address voltage to such a voltage as can be scanned easily by a commercial LSI and which is capable of saving the auxiliary discharge conducted so far in the prior art for forming wall charges.

A second object of the invention is to provide a gas discharging type display panel and a display device capable of suppressing erroneous light emission of a fluorescent layer and of improving the contrast on the display screen.

A third object of the invention is to provide a gas discharging type display panel and a display device capable of suppressing ion damage on a fluorescent layer.

A fourth object of the invention is to provide a method of manufacturing a gas discharging type display panel and a display device capable of simplifying steps for forming barrier ribs and capable of improving the manufacturing yield compared with the prior art.

For attaining the first object, in accordance with the present invention, address electrodes are formed on barrier ribs. The forming of address electrodes between barrier ribs and address electrodes formed on the barrier rib as in the present invention can reduce the distance between the address electrodes and the display electrodes thereby making it possible to lower the address voltage. Further, not only is the distance between the address electrodes and the display electrodes shortened, but also a discharging space comparable with that in the prior art can be ensured. Particularly, since the address voltage can be lowered to such a voltage as can be scanned easily by a commercial LSI, it is also possible to save the auxiliary discharge conducted so far in the prior art for forming wall charges.

Further, for attaining the second and the third objects in accordance with the present invention, address electrodes are formed on barrier ribs and a fluorescent body is disposed on the wall surface of the barrier ribs. Since this can ensure the distance between the display electrodes and the fluorescent layer as usual even if the distance between the address electrodes and the display electrodes is shortened, degradation and erroneous emission of the fluorescent layer are not increased. Further, since the fluorescent layer is not present on the address electrodes, degradation on erroneous light emission of the fluorescent layer can be suppressed upon address discharge.

In addition, for attaining the fourth object in accordance with the present invention, barrier ribs are formed by engraving the back substrate itself. This can save steps for laminating materials for forming the barrier ribs and simplify the manufacturing process.

BRIEF DESCRIPTION OF THE DRAWINGS

FIG. 1(*b*) is a cross sectional view taken along line A-B in FIG. 1(*a*).

FIG. 1(*c*) is a cross sectional view taken along line C-D in FIG. 1(*a*).

FIG. 3(*b*) is a cross sectional view taken along line A-B in FIG. 3(*a*).

FIG. 3(*c*) is a cross sectional view taken along line C-D in FIG. 3(*a*).

FIG. 5(*b*) is a cross sectional view taken along line A-B in FIG. 5(*a*).

FIG. 5(*c*) is a cross sectional view taken along line C-D in FIG. 5(*a*).

FIG. 6(*b*) is a diagrammatic view similar to FIG. 6(*a*) but showing a modified structure.

FIG. 7(*b*) is a cross sectional view taken along line A-B in FIG. 7(*a*).

FIG. 7(*c*) is a cross sectional view taken along line C-D in FIG. 7(*a*).

FIG. 8(*b*) is a diagrammatic view similar to FIG. 8(*a*) but showing a modified structure.

FIG. 9(*b*) is a cross sectional view taken along line A-B in FIG. 9(*a*).

FIG. 9(*c*) is a cross sectional view taken along line C-D in FIG. 9(*a*).

FIG. 10(*b*) is a cross sectional view taken along line A-B in FIG. 10(*a*).

FIG. 10(*c*) is a cross sectional view taken along line C-D in FIG. 10(*a*).

FIG. 11(*b*) is a cross sectional view taken along line A-B in FIG. 11(*a*).

FIG. 11(*c*) is a cross sectional view taken along line C-D in FIG. 11(*a*).

FIG. 12(*b*) is a cross sectional view taken along line A-B in FIG. 12(*a*).

FIG. 12(*c*) is a cross sectional view taken along line C-D in FIG. 12(*b*).

FIG. 13(*b*) is a cross sectional view taken along line A-B in FIG. 13(*a*).

FIG. 13(*c*) is a cross sectional view as seen in the direction X in FIG. 13(*a*).

FIG. 14(*b*) is a cross sectional view taken along line A-B in FIG. 14(*a*).

FIG. 14(*c*) is a cross sectional view as seen in the direction X in FIG. 14(*a*).

FIG. 15(*b*) is a cross sectional view taken along line A-B in FIG. 15(*a*).

FIG. 15(*c*) is a cross sectional view taken along line C-D in FIG. 15(*a*).

FIG. 17(*b*) is a cross sectional view taken along line A-B in FIG. 17(*a*).

FIG. 17(*c*) is a cross sectional view taken along line C-D in FIG. 17(*a*).

FIG. 18(*b*) is a diagrammatic view similar to FIG. 18(*a*) but showing a modified structure.

FIG. 19(*b*) is a cross sectional view taken along line A-B in FIG. 19(*a*).

FIG. 19(*c*) is a cross sectional view taken along line C-D in FIG. 19(*a*).

FIG. 20(*b*) is a cross sectional view taken along line A-B in FIG. 20(*a*).

FIG. 20(*c*) is a cross sectional view taken along line C-D in FIG. 20(*a*).

FIG. 21(*b*) is a cross sectional view taken along line A-B in FIG. 21(*a*).

FIG. 21(*c*) is a cross sectional view taken along line C-D in FIG. 21(*a*).

FIG. 23(*b*) is a cross sectional view taken along line A-B in FIG. 23(*a*).

FIG. 23(*c*) is a cross sectional view taken along line C-D in FIG. 23(*a*).

DETAILED DESCRIPTION OF THE PREFERRED EMBODIMENTS

Figure 1A:
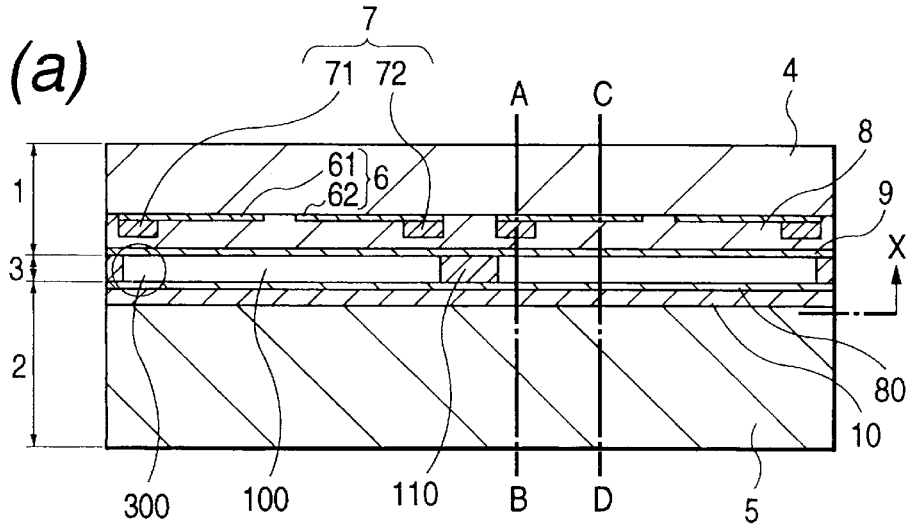
FIG. 1(*a*) is a cross sectional view of a gas discharging type display device taken in parallel with the address electrodes and illustrating a first embodiment according to the present invention.

The present invention will be explained in detail by reference to the preferred embodiments illustrated in the drawings.

Embodiment 1

Figure 1B:
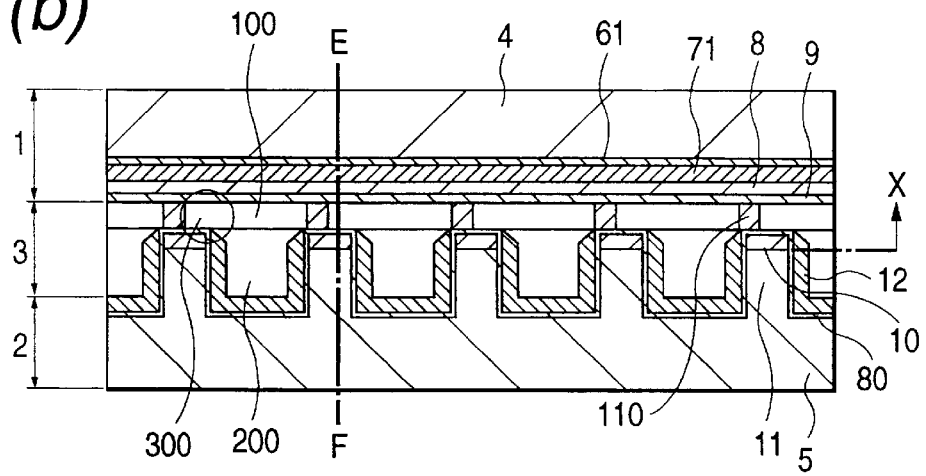
Figure 1C:
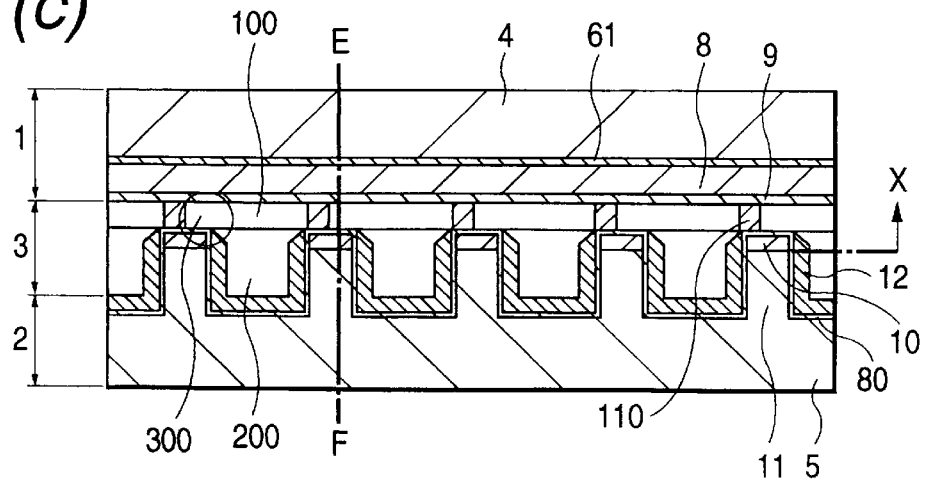

A first embodiment of the present invention will be explained with reference to FIGS. 1(*a*), 1(*b*), 1(*c*) and FIG. 2, which are cross sectional views of a portion of a gas discharging type display device to which the present invention is applied. FIG. 1(*a*) shows a cross section in parallel with the address electrodes, FIG. 1(*b*) shows a cross section along line A-B shown in FIG. 1(*a*), which is transverse to the address electrodes, and FIG. 1(*c*) shows a cross section along line C-D shown in FIG. 1(*a*), which is transverse to the address electrodes. FIG. 1(*a*) represents a cross section along line E-F shown in FIG. 1(*b*) and FIG. 1(*c*).

As seen in the drawings, the display device includes a front substrate 1, a back substrate 2, a discharging space region 3, a front glass substrate 4, a back glass substrate 5, display electrodes 61 and 62 made of a transparent conductive material and collectively referred to as display electrode 6, bus electrodes 71 and 72 disposed so as to partially overlap with the display electrodes, a bus electrode 7 which includes electrodes 71 and 72, a dielectric layer 8, a protection layer 9 made of MgO, barrier ribs 11 disposed on the back substrate, a barrier rib 110 disposed on the front substrate, a fluorescent layer 12, a main discharging space 100 partitioned by barrier ribs on the side of the front substrate for generating a main discharge for display, an address discharging space 300 for generating an address discharge for selecting a display cell, and a discharging space 200 on the side of the back substrate.

Figure 2:
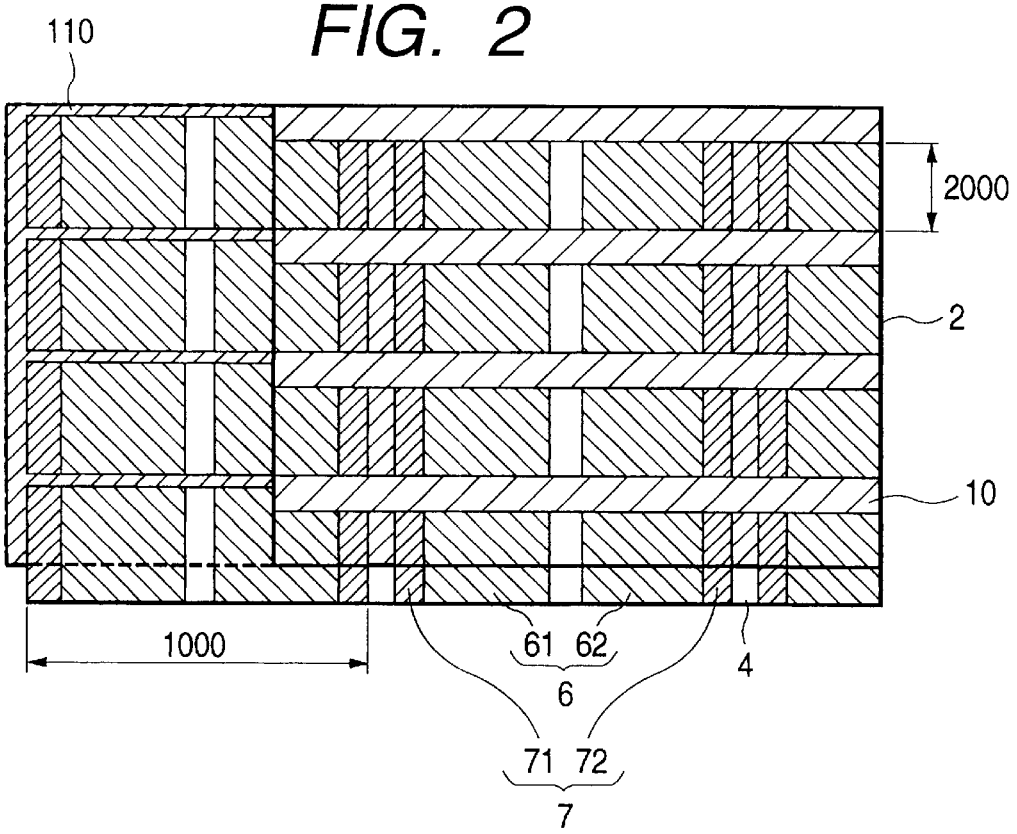
FIG. 2 is a diagrammatic view illustrating a positional relationship between the address electrodes and the barrier ribs on the side of a front substrate, and the display electrodes and the bus electrodes in the first embodiment as viewed from the direction X in FIG. 1(*a*).
Figure 4:
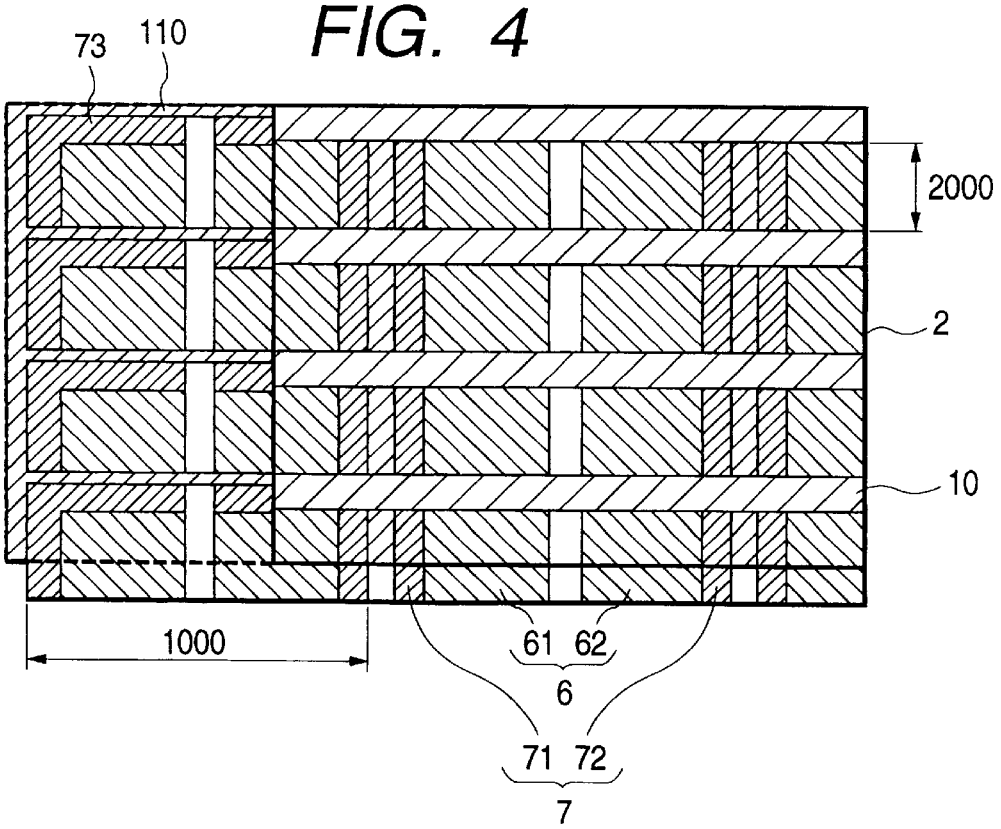
FIG. 4 is a diagrammatic view illustrating a positional relationship between the address electrodes and the barrier ribs on the side of a front substrate, and the display electrodes and the bus electrodes in the second embodiment as viewed from the direction X in FIG. 3(*a*).

FIG. 2 is a diagrammatic view illustrating a positional relationship between the address electrodes and the barrier ribs on the side of the front substrate, and the display electrodes and the bus electrode disposed on the front substrate, as viewed from the direction X shown in FIG. 1(*a*) (with reference to the first embodiment). A portion in the figure surrounded by a heavy solid line is a view of the front substrate from just beneath the address electrode 10 formed on the back substrate 2, a portion surrounded by a broken line is a view of the front substrate from just beneath the barrier rib 110 on the side of the front substrate and other portions show the display electrodes 6 and the bus electrodes 7 disposed on the front substrate 1. FIG. 4 is not in fact a cross sectional view, but the display electrodes 6 and the bus electrodes 7, the barrier ribs 110 on the side of the front substrate and the address electrodes 10 are hatched, and the dielectric layer 8 and the protection layer 9 formed to the front substrate are not illustrated, for ease in understanding. In the figure, a display electrode cell row 1000 representing a display cell row is arranged in the extending direction of the display electrode and an address electrode cell row 2000 representing a display cell row is arranged in the extending direction of the address electrode.

Figure 24:
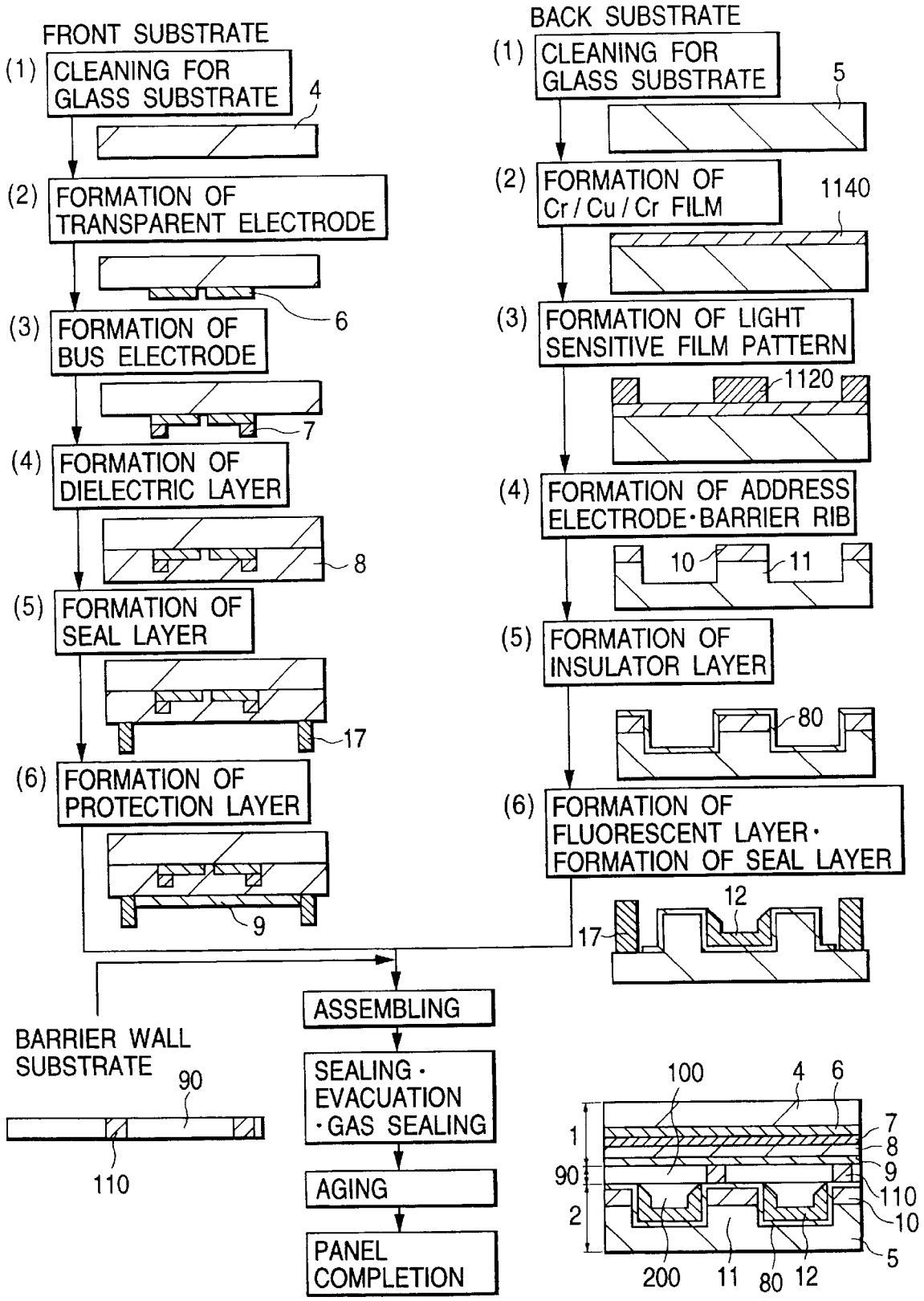
FIG. 24 is a step flow chart illustrating an example of a manufacturing method for the first embodiment according to the present invention.

An example of a manufacturing method for the first embodiment will be explained with reference to FIG. 24.

At first, an example of the manufacturing method for the front substrate 1 will be explained.

(1) A glass plate, such as made of soda lime glass for preparing the front glass substrate 4, is cleaned by a neutral detergent or the like.

(2) A transparent conductive film, such as a tin oxide ($SnO_2$ film or an ITO (Indium Tin Oxide) film, is formed by a film forming method, such as sputtering or electron beam vapor deposition, on the cleaned front glass substrate 4. Then, the transparent conductive film is fabricated by a well-known photoetching process to form an electrode pattern that functions as display electrodes 61 and 62. The pattern size of the display electrode may be determined in accordance with the size of the discharge cell to be manufactured.

(3) A Cr/Cu/Cr laminate film, in which a copper (Cu) film is sandwiched between chromium (Cr) films, is formed on the front glass substrate 4 on which the display electrodes 61 and 62 are formed using a film forming method, such as sputtering or electron beam vapor deposition. Then, the Cr/Cu/Cr laminate film is fabricated by using a well-known photoetching process to form a pattern which will partially overlap with the display electrodes 61 and 62 to prepare bus electrodes 71 and 72. The thickness of the Cu layer and the pattern size of the bus electrode may be determined depending on the resistance value required for the bus electrode.

(4) A hydrolyzable coating agent mainly composed of aluminum (Al), silicon (Si) and oxygen (O) (alkoxide, etc.) is coated, for example, by blading or spraying onto a predetermined area of the front glass substrate 4 on which the display electrode 6 and the bus electrode 7 are formed, and the coating is heated to a temperature of 100 to 400° C. for 1 to 60 min, thereby forming a dielectric layer 8 having a film thickness of from 0.002 to 0.05 mm.

(5) A seal layer 17 for vacuum sealing is formed on the back glass substrate 4 on which the dielectric layer 8 is formed by using, for example, a printing process.

(6) An MgO film is formed to a predetermined area by using a film forming method, such as sputtering or electron beam vapor deposition, to prepare a protection layer 9. The thickness of the MgO film has to be determined in accordance with a working life required for the gas discharging type display device, and a typical value is from 0.001 to 0.002 mm.

The front substrate 1 on which the display electrode 6 is disposed is completed by the steps described above.

Now, an example of the manufacturing method for the back substrate 2 will be explained.

(1) A glass plate, such as made of soda lime glass for preparing the back glass substrate 5, is cleaned by using, for example, a neutral detergent.

(2) A Cr/Cu/Cr laminate film (conductor film) 1140 is formed on the cleaned back glass substrate 5 by using a film forming method, for example, sputtering or electron beam vapor deposition. The thickness of the Cu layer may be determined depending on the resistance value required for the address electrode 10.

(3) A light sensitive film 1120 is laminated on the back glass substrate 5 on which the Cr/Cu/Cr laminate film 1140 is formed, and well-known exposure, development, water washing and drying methods are applied to prepare a predetermined light sensitive film pattern.

(4) A portion of the back glass substrate 5 not coated with the light sensitive film 1120 is removed by sand blasting to form an address electrode pattern 10 and barrier ribs 11 on the side of the back substrate for partitioning the discharging space 200. Then, the light sensitive film 1120 is removed by using a well-known method.

(5) A hydrolyzable coating agent, mainly composed of Al, Si and O (alkoxide, etc.), is coated, for example, by blading or spraying onto a predetermined area of the back glass substrate 5 on which the address electrode 10 and the barrier rib 11 are formed, and the coating is heated to a temperature of 100 to 400° C. for 1 to 60 min, thereby forming an insulator layer 80. The thickness of the insulator layer 80 may be determined depending on the amount to be consumed by the address discharge, and a typical value is from 0.002 to 0.05 mm.

(6) A fluorescent layer 12 is coated on the inner wall of the barrier rib 11 forming the discharging space 200 on the side of the back substrate, for example, by spraying or blading. In a case of a gas discharging display device for color display, fluorescent layers 12 emitting colors of green, blue and red are coated by aligning masks of predetermined patterns for green, blue and red. Then, a heat treatment is applied at a temperature from 150 to 300° C. for 5 to 60 min. A pattern of frit glass is formed by using, for example, a thick-film printing method, and the result is dried to form a seal layer 17 for vacuum sealing.

By the steps described above, the back substrate 2 having the barrier ribs 11 forming the discharging spaces 200 on the side of the back substrate, the fluorescent layers 12 and the address electrodes 10 is completed. The back substrate 2 is provided with a tip tube (not illustrated) for exhaustion and gas introduction after panel assembling.

The front substrate 1 and the back substrate 2 prepared by the steps described above are assembled while effecting alignment with a partition wall substrate 90 formed by covering a metal film having openings disposed at locations each corresponding to each of the display cells with an insulator film, and the arrangement is subjected to a heat treatment at 300 to 450° C., to fix these substrates. In this case, the display electrodes 6 and the bus electrodes 7 disposed on the front substrate 1 and the address electrodes 10 disposed on the back substrate 5 are substantially perpendicular to each other, and the barrier wall substrate 90 is sandwiched between the front substrate 1 and the back substrate 2. Then, the discharging space defined between the front substrate 1 and the back substrate 2 is evacuated through the tip tube (not illustrated) disposed in the back substrate; and, for example, Ne containing 3% Xe is introduced into the main discharging space 100, and the pressure in the discharging space is adjusted to 35–70 kPa. Then, the tip tube (not illustrated) is locally heated to seal it off, to complete the gas discharging type display device shown in FIG. 1(*a*). The barrier rib 110 forming the discharging space on the side of the front substrate is formed by the partition wall substrate 90.

In this embodiment, Cu and Cr are used as the material for the bus electrodes 7 and the address electrodes 10, but Al or metals such as Au, Ti, Ni, W or Mo, or alloys thereof may also be used. Further, sputtering or electron beam vapor deposition is adopted as a method of forming the material constituting the bus electrodes 7 and the address electrodes 10, but there is no particular restriction on the method of forming them, since plating, ohmic heat vapor deposition or thick-film printing may also be used. Further, the transparent conductive material used for the display electrode 6 is not restricted to tin oxide or ITO. In addition, the forming method is not restricted to sputtering or electron beam vapor deposition, but chemical gas phase reaction or sol-gel method may also be used. While the alkoxide is used for the formation of the dielectric layer 8 and the insulator layer 80, the invention is not restricted to use such a material. Further, a combined method of blading or spraying and heat setting is adopted as a method of forming the dielectric layer 8 and the insulator layer 80, but there is no restriction on the forming method, since sputtering, chemical gas phase reaction, a thick-film printing method and the like may also be used. While MgO is used for the protection layer 9, CaO, SrO or a mixture of them may be used in addition to MgO providing that the material has a low sputtering ratio relative to the discharging gas and a high secondary electron emission coefficient. Further, while the insulator layer 80 suffers from plasma (ion) damage during address discharge or the like, it is desirable for the layer to be formed with the same material as that used for the protection layer 9 which has an excellent sputtering resistance to the discharging gas, that is, MgO or the like, if the consumption is remarkable.

In this embodiment, the barrier ribs 110 forming the discharging space on the side of the front substrate are formed by the partition wall substrate 90 comprising a metal plate having openings and covered with the insulation film, but the invention is not restricted only to use of a metal plate covered with an insulation film, but the partition wall substrate 90 may also be prepared from a plate material made of insulating material, such as ceramic or glass, and be provided with openings. Further, a gas mixture of Ne and Xe is used as the discharging gas, but there is no particular restriction to the use of such a gas.

Since the gas discharging type display device of this embodiment to which the present invention is applied can be manufactured by a process at a low temperature of 450° C. or lower, glass having low distortion point, which is also inexpensive in cost, can be used as a substrate. However, the temperature for the manufacturing process is not required to be lower than 450° C., and the gas discharging type display device of this embodiment can be manufactured also by a manufacturing process at a temperature higher than 450° C.

In the gas discharging type display device illustrated by this embodiment, the discharging space is formed between the front substrate 1 and back substrate 2 by sealing, for example, and an Ne gas containing 3% Xe is contained therein. The barrier ribs 110 on the side of the front substrate form the main discharging spaces 100 for generating a main discharge for display by contact with the surface of the front substrate 1 and further form the address discharging spaces 300 by contact with the barrier ribs 11 of the back substrate 2. As can be seen from FIG. 1(*a*) and FIG. 2, the discharging space in each display cell on the side of the front substrate comprising the main discharging space 100 and the address discharging space 300 is separated from every other display cell by the barrier ribs 110 on the side of the front substrate. On the contrary, the space 200 on the side of the back substrate partitioned by the barrier ribs 11 on the side of the back substrate is separated from every other display cell in the display cell row 1000 arranged in the extending direction of the display electrode 6 (hereinafter referred to as the display electrode cell row), but is used in common in the display cell row 2000 arranged in the extending direction of the address electrode 10 (hereinafter referred to as the address electrode cell row). The fluorescent layer 12 is formed on the inner wall on the side of the back substrate for forming the discharging space.

As can be seen from FIG. 1(*b*) and FIG. 2, the address electrodes 10 in this embodiment are disposed on the barrier ribs 11 partitioning the discharging space 200 on the side of the back substrate, and, as seen in FIG. 1(*a*), the display electrodes 6 or the bus electrodes 7 are opposed to the address electrodes 10 with the address discharging space 300 being interposed therebetween, by making the width of the barrier rib 110 on the side of the front substrate extending in the direction along which the address electrode 10 extends smaller than the width of the address electrode 10 (that is, the barrier rib 11 on the side of the back substrate). This allows discharge to be generated between the display electrode 6 or the bus electrode 7 and the address electrode 10. This discharge is stabilized by diverging from the barrier rib 110 by more than 0.01 mm. This is because the loss of charge particles on the surface of the barrier rib 110 can be reduced. A main discharge for display is generated also in this embodiment by applying a voltage between the display electrodes 61 and 62, like that in the standard gas discharging type display device shown in FIG. 22 and FIG. 23.

In the gas discharging type display device shown in this embodiment, a display cell is selected by applying a voltage between the address electrode 10 and one electrode 61 (or 71) or electrode 62 (or 72) of the display electrode 6 (or bus electrode 7), and a main discharge is generated by applying a voltage between the display electrodes 61 and 62. It is often the case that one of the display electrodes 61 and 62 (electrode 62 in this embodiment) is used as a common electrode, which is used in common with all the display cells, and the other electrode (electrode 61 in this embodiment) is used as a common electrode for the display electrode cell row 1000. When an address discharge is generated between the display electrode 61 and the address electrode 10, one display cell is selected by the address discharge. On the contrary, when the address discharge is generated between the display electrode 62 and the address electrode 10, and the address electrode cell row 2000 is selected by the address discharge, one display cell is selected by selecting the display electrode cell row 2000 for generating the main discharge by applying a voltage between the display electrodes 61 and 62. That is, when the address voltage is applied between the display electrode 61 and the address electrode 10, an address discharge is generated only in one display cell, whereas an address discharge is generated in all of the display cells of one address electrode cell row when the address voltage is applied between the display electrode 62 and the address electrode 10.

The main features of the present invention in this embodiment of the invention are as follows.

The first feature of the present invention resides in the fact that the discharging space formed between the front substrate 1 and the back substrate 2 is constituted with a discharging space on the side of the front substrate comprising the main discharging space 100 for generating a main discharge for display and the address discharging space 300 for generating an address discharge for selecting the display cell, and a discharging space 200 on the side of the back substrate partitioned by fluorescent lay 11 having the fluorescent layer 12 formed on the inner wall. The second feature of the present invention resides in the fact that the address discharging space 300 is formed by disposing the address electrode 10 on the barrier rib 11 for forming the discharging space 200 on the side of the back substrate and forming a space between the front substrate 1 and the address electrode 10 by the barrier rib 110 on the side of the front substrate. This makes it possible to adjust the address voltage for generating an address discharge according to the height of the barrier rib on the side of the front substrate, whereby the effect of the address discharge on the fluorescent layer 12 can be suppressed. The third feature of the present invention resides in forming only the fluorescent layer 12 on the inner wall of the barrier rib 11 forming the discharging space 200 on the side of the back substrate (in the existent discharging type display device, the address electrode 10 and the fluorescent layer 12 are formed). The fourth feature of the present invention resides in the fact that the barrier rib 11 forming the discharging space 200 on the side of the back substrate is formed with a portion of the back glass substrate 5. This makes it possible to easily form the address electrode 10 on the barrier rib 11 for forming the discharging space 200 on the side of the back substrate. A fifth feature of the present invention is to use, as a manufacturing method for the back substrate 2, the steps shown in FIG. 24 for forming a conductor layer constituting the address electrode and then forming the barrier rib 11 for forming the address electrode pattern 10 and the discharging space 200 on the side of the back substrate. This can simplify the manufacturing steps for the back substrate compared with the prior art.

Advantageous effects obtained by this embodiment to which the present invention is applied are summarized below in comparison with the standard gas discharging type display device.

(1) Since the distance between the address electrode 10 and the display electrode 6 (or bus electrode 7) is reduced, the address voltage for generating an address discharge between the address electrode 10 and the display electrode 6 (or bus electrode 7) can be lowered. The address voltage can be controlled depending on the height of the barrier rib 110 on the side of the front substrate. For example, the address voltage can be lowered to ⅖ of that of the standard gas discharging type display device (having about a 0.2 mm distance between the display electrode 6 and the address electrode 10) by reducing the distance between the display electrode 6 and the address electrode 10 to 0.08 mm, for instance. This can eliminate the requirement for the auxiliary discharge of forming wall charges for reducing the address voltage, making it easy to provide gradation to the display on the display screen.

(2) As described in (1) above, since the auxiliary discharge for forming the wall charge in order to lower the address voltage is not required, and the address discharge is conducted in the address discharging space in which the fluorescent layer 12 is not present, the brightness in the black display state can be lowered to enhance the contrast.

(3) As described in (1) above, since the auxiliary discharge for forming the wall charge in order to lower the address voltage is not required and the fluorescent layer 12 is not present between the address electrode 10 and the display electrode 6 (or bus electrode 7), ion damage by discharge to the fluorescent layer 12 can be suppressed. This can attain an improvement in the working life of the fluorescent layer 12.

(4) Since the address electrode pattern 10 and the barrier ribs 11 for forming the discharging spaces 200 on the side of the back substrate can be formed by one process and the barrier ribs 110 on the side of the front substrate can be used as the partitioning wall substrate 9 that can be manufactured by a simple step, the manufacturing steps can be simplified and the manufacturing yield can be further improved as compared with the standard manufacturing method for the gas discharging type display device.

(5) Since the barrier rib 11 can be formed at a temperature lower than the distortion point of soda lime glass, deformation of the glass substrate can be suppressed and the improvement of the manufacturing yield can be expected.

As has been described above, the first embodiment of the present invention can provide a gas discharging type display device with a lowered address voltage even without forming wall charges, which produces a high contrast image on the display screen and capable of suppressing ion damage on the fluorescent layer, making it is possible to obtain advantageous effects capable of shortening the steps of manufacture and improving the yield in the manufacturing of the gas discharging type display device.

Embodiment 2

Figure 3A:
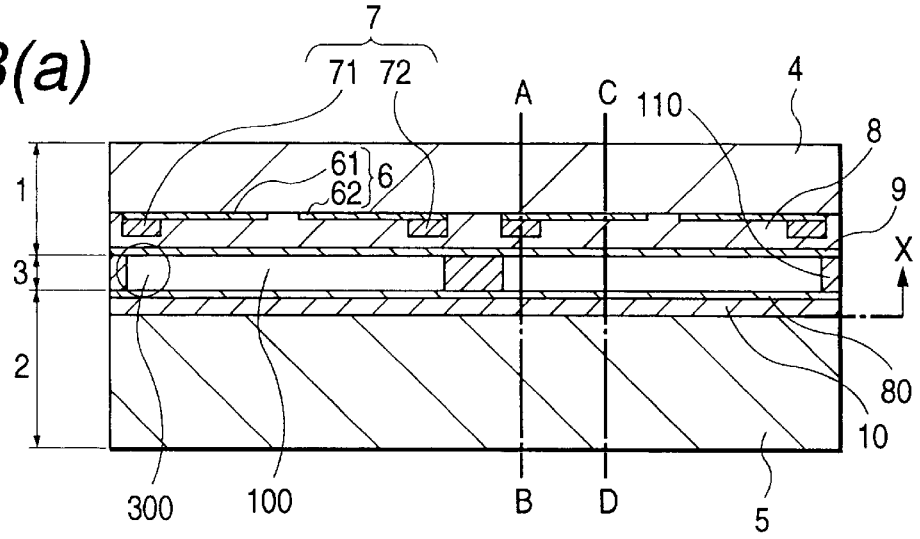
FIG. 3(*a*) is a cross sectional view of a gas discharge type display device taken in parallel with the address electrodes and illustrating a second embodiment according to the present invention.
Figure 3B:
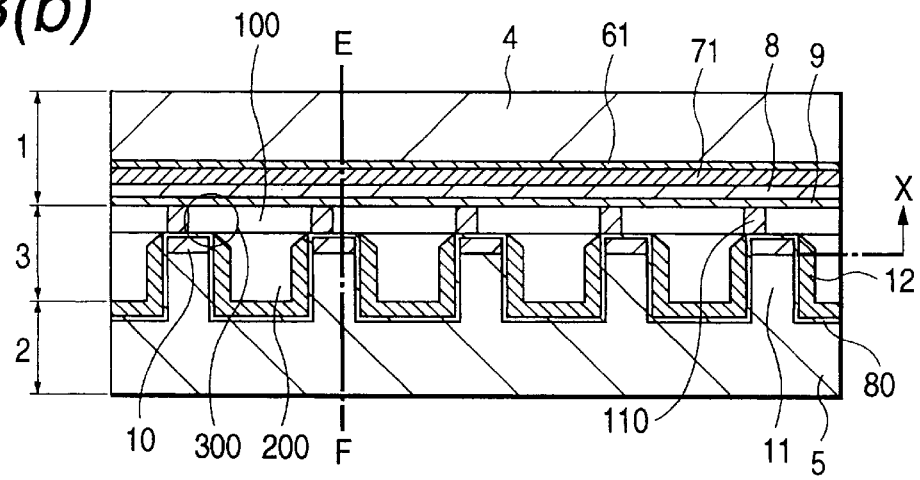
Figure 3C:
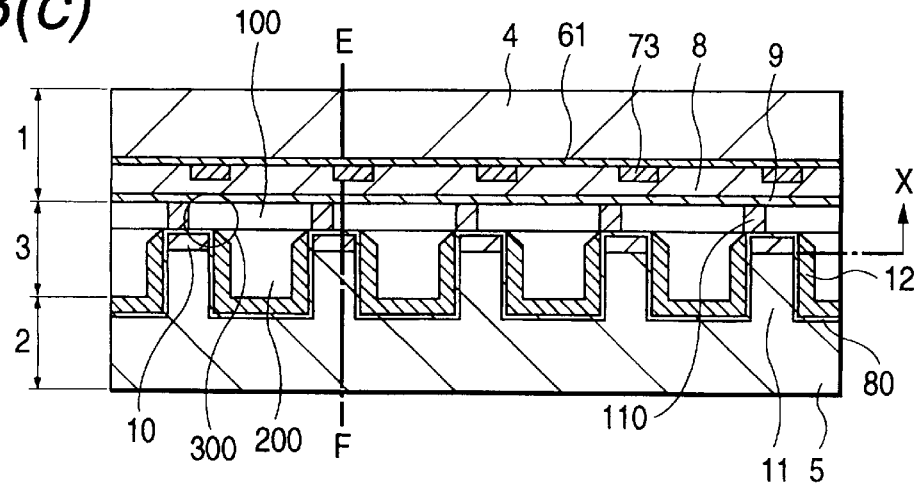

A second embodiment according to the present invention will be explained with reference to FIGS. 3(*a*), 3(*b*), 3(*c*) and FIG. 4, which are a cross sectional views of a portion of a gas discharging type display device to which the present invention is applied. FIG. 3(*a*) shows a cross section in parallel with the address electrodes, FIG. 3(*b*) shows a cross section taken along line A-B shown in FIG. 3(*a*), which is transverse to the address electrodes, and FIG. 3(*c*) shows a cross section taken along line C-D shown in FIG. 3(*a*), which is transverse to the address electrodes. FIG. 3(*a*) illustrates a cross section taken along line E-F shown in FIG. 3(*b*) and FIG. 3(*c*). In FIG. 3(*c*), 73 denotes a branched portion of a bus electrode which extends to an opposed electrode for conducting main discharging.

FIG. 4 is a diagrammatic view illustrating a positional relationship between the address electrodes and the barrier ribs on the side of the front substrate, and the display electrodes and the bus electrodes disposed on the front substrate of the second embodiment, as viewed in the direction X shown in FIG. 3(*a*). A portion in the figure surrounded with a heavy solid line is a view of the front substrate from just beneath the address electrode 10 formed on the back substrate 2, a portion surrounded by a dotted line is a view of the front substrate from just beneath the barrier rib 110 on the side of the front substrate, and other portion shows the display electrodes 6 and the bus electrodes 7 disposed on the front substrate 1. While FIG. 4 is not a cross sectional view, the display electrodes 6, the bus electrodes 7, the barrier ribs 110 on the side of the front substrate and the address electrodes 10 are hatched, and the dielectric layer 8 and the protection layer 9 formed on the front substrate are not illustrated, for ease in understanding.

As can be seen from FIG. 3(*c*) and FIG. 4, this embodiment is different from the first embodiment in that the bus electrode 71 on the display electrode 61 is extended by a branched portion 73 to the opposed electrode (display electrode) 62 for generating the main discharge, and the bus electrode 72 on the display electrode 62 is extended by the branched portion 73 to the opposed electrode (display electrode) 61 for generating the main discharge, at those places where the address electrodes 10 and the display electrodes 6 intersect to form the address discharging spaces 300. That is, the branched portion 73 of the bus electrode 7, extends between the opposed electrodes 61 and 62 for conducting the main discharge, at the places where the address electrodes 10 and the display electrodes 6 intersect. The remaining structural arrangement, manufacturing method and features applicable to the present invention are identical with those in the first embodiment. Accordingly, this embodiment also can provide the same effects as those attained in the first embodiment.

In this embodiment, by providing a non-transparent branched portion 73 as part of the bus electrode 7 at those places where the address electrodes 10 and the display electrodes 6 intersect, light emitted by the address discharge generated between the address electrode 10 and the display electrode 6 can be shielded, as viewed from the front substrate 1. That is, since the effect of light emission by the address discharge to the display screen can be suppressed, the quality of the black display state can be enhanced and the contrast is improved. Further, the presence of the branched portions 73 of the bus electrode 7 of low resistance allows the width of the electrode at the branched portion to be increased, having the effect of further lowering the resistance of the bus electrode 7.

In this case, an address discharge is generated between the display electrode 61 (bus electrode 71) and the address electrode 10, but the address discharge may be generated between the display electrode 62 (bus electrode 72) and the address electrode 10.

Embodiment 3

Figure 5A:
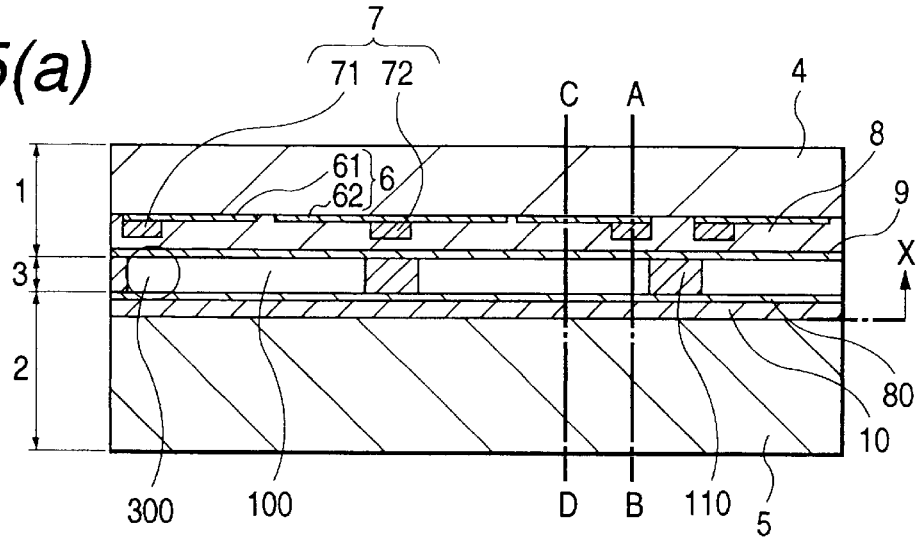
FIG. 5(*a*) is a cross sectional view of a gas discharge display device taken in parallel with the address electrodes and illustrating a third embodiment according to the present invention.
Figure 5B:
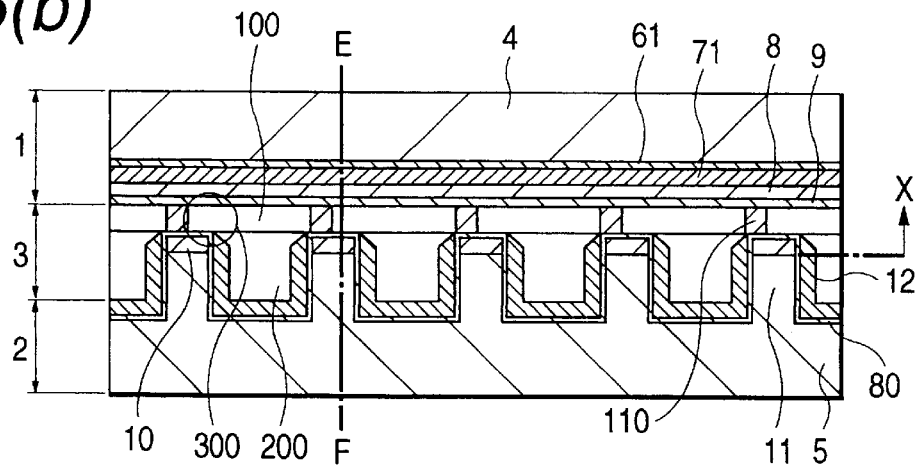
Figure 5C:
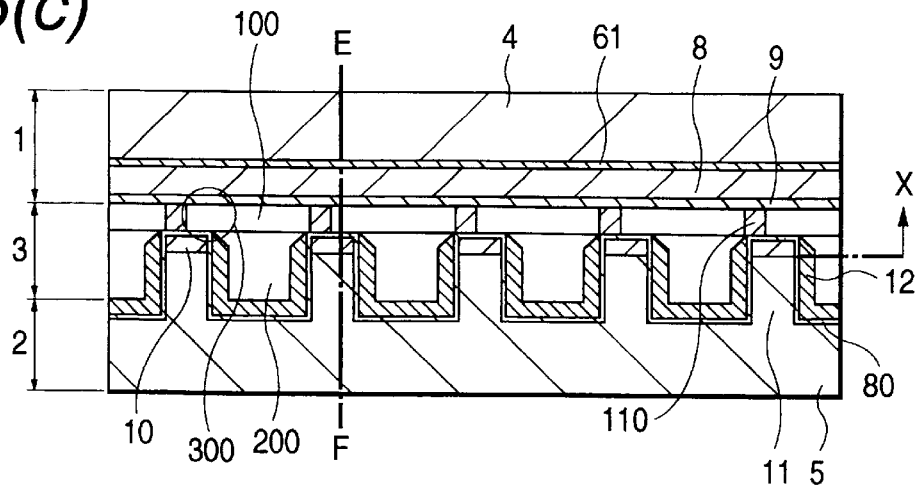

A third embodiment according to the present invention will be explained with reference to FIGS. 5(*a*), 5(*b*), 5(*c*) and FIG. 6, which are cross sectional views of a portion of a gas discharging type display device to which the present invention is applied. FIG. 5(*a*) shows a cross section in parallel with the address electrodes, FIG. 5(*b*) shows a cross section taken along line A-B shown in FIG. 5(*a*), which is transverse to the address electrodes, and FIG. 5(*c*) shows a cross section taken along line C-D shown in FIG. 5(*a*), which is transverse to the address electrodes. FIG. 5(*a*) illustrates a cross section taken along line E-F shown in FIG. 5(*b*) and FIG. 5(*c*).

Figure 6A:
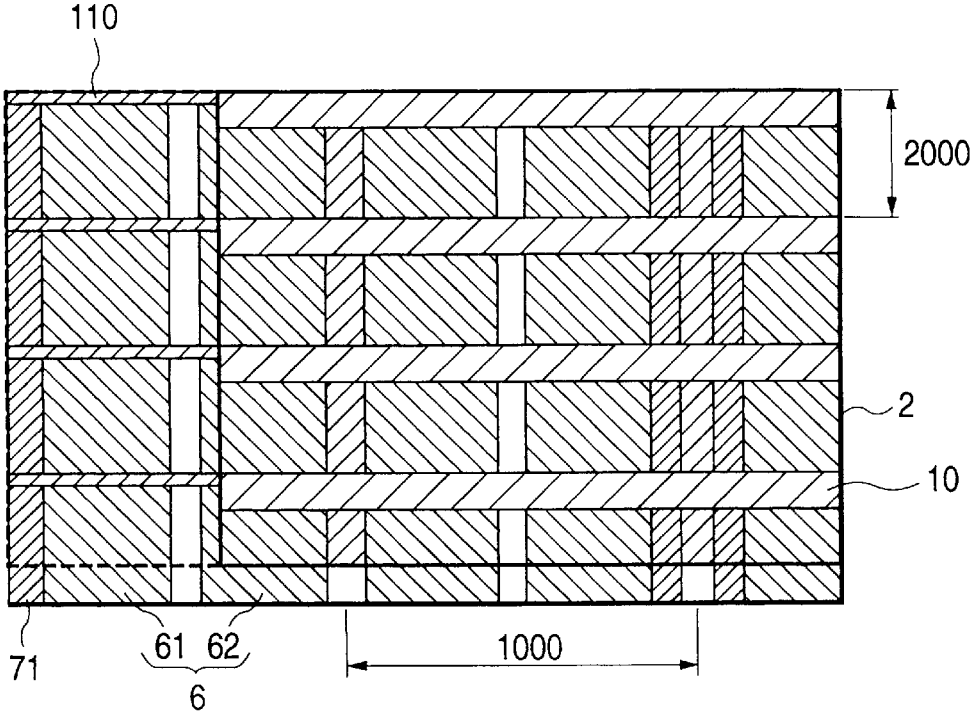
FIG. 6(*a*) is a diagrammatic view illustrating a positional relationship between the address electrodes and the barrier ribs on the side of a front substrate, and the display electrodes and the bus electrodes in the third embodiment as viewed from the direction X in FIG. 5(*a*).
Figure 6B:
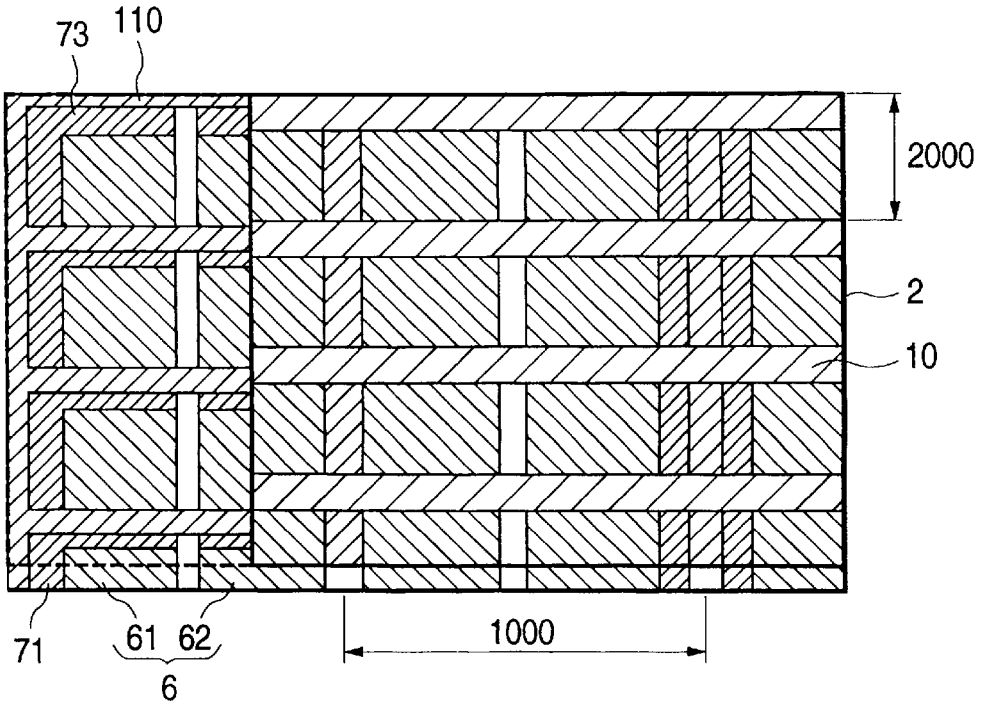

FIG. 6(*a*) is a diagrammatic view illustrating a positional relationship between the address electrodes, and the barrier ribs on the side of the front substrate, and the display electrodes and the bus electrodes disposed on the front substrate of the third embodiment, as viewed in the direction X shown in FIG. 5(*a*). A portion in the figure surrounded with a heavy solid line is a view of the front substrate from just beneath the address electrode 10 formed on the back substrate 2, a portion surrounded by a dotted line is a view of the front substrate from just beneath the barrier rib 110 on the side of the front substrate and the remaining portion shows the display electrodes 6 and the bus electrodes 7 disposed on the front substrate 1. While FIG. 6(*a*) is not a cross sectional view, the display electrodes 6, the bus electrodes 7, the barrier ribs 110 on the side of the front substrate and the address electrodes 10 are hatched, and the dielectric layer 8 and the protection layer 9 formed on the front substrate are not illustrated, for ease in understanding.

As can be seen from FIG. 5(*a*), this embodiment is different from the first embodiment in that three display electrodes 61 and 62 are provided in every two display electrode cell rows, and the central electrode 62, among the three display electrodes 61, 62, is disposed in over-riding relationship in the two rows of display electrode cells. The remaining structural arrangement, manufacturing method, and features applicable to the present invention are identical with those in the first embodiment. The display electrode 62, which is present in over-riding relationship relative to two rows of display electrode cells, functions as a common electrode for generating the main discharge for display. The bus electrode 72 on the display electrode 62 is desirably arranged so as to overlap the barrier rib 110 for forming the discharging space on the side of the front substrate in order to prevent the lowering of the degree of opening of the display cell. Further, in this embodiment, while the display electrode 62 constitutes a common electrode riding over adjacent display electrode cell rows, it need not always over-ride but it may suffice that only the bus electrode 72 over-rides them.

This embodiment is identical with the first embodiment in general structural arrangement, manufacturing method, and the features applicable to the present invention, except for the display electrode, and so the same effects as those obtained by the first embodiment can be attained. Further, when this embodiment is compared with the first embodiment, the opening degree is made larger by the difference in the structure of the display electrodes 6 and bus electrodes 7, thereby obtaining higher brightness than in the case of the first embodiment. It is apparent that this can even further increase the contrast on the display screen as compared to that in the first embodiment.

Further, in this embodiment, as shown in FIG. 6(*b*), it is desirable to dispose a branched portion 73 of the non-transparent bus electrode having low resistance at those locations where the address electrodes 10 and the display electrodes 6 intersect. In this case, advantageous effects of improving the contrast on the display screen and lowering the resistance of the bus electrodes 7 can be obtained in the same manner as in the second embodiment.

In this embodiment, the address discharge is generated between a display electrode 61 (bus electrode 71) inherent to the display electrode cell row and an address electrode 10, but the discharge may also be generated between a display electrode 62 (bus electrode 72) acting as a common electrode in the main discharge and an address electrode 10.

Embodiment 4

Figure 7A:
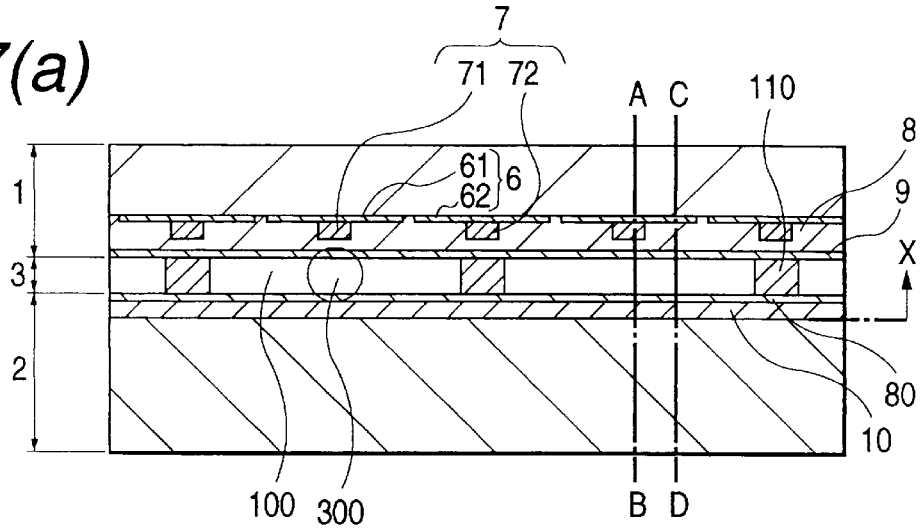
FIG. 7(*a*) is a cross sectional view of a gas discharging type display device taken in parallel with the address electrodes and illustrating a fourth embodiment according to the present invention.
Figure 7B:
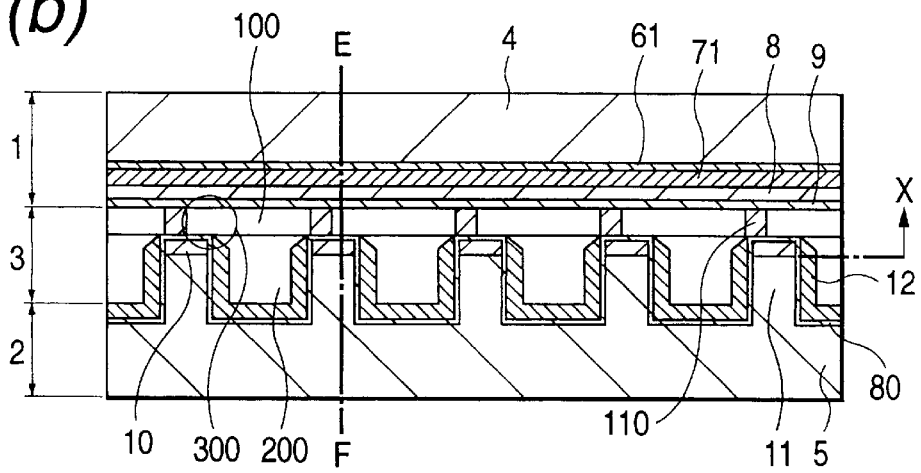
Figure 7C:
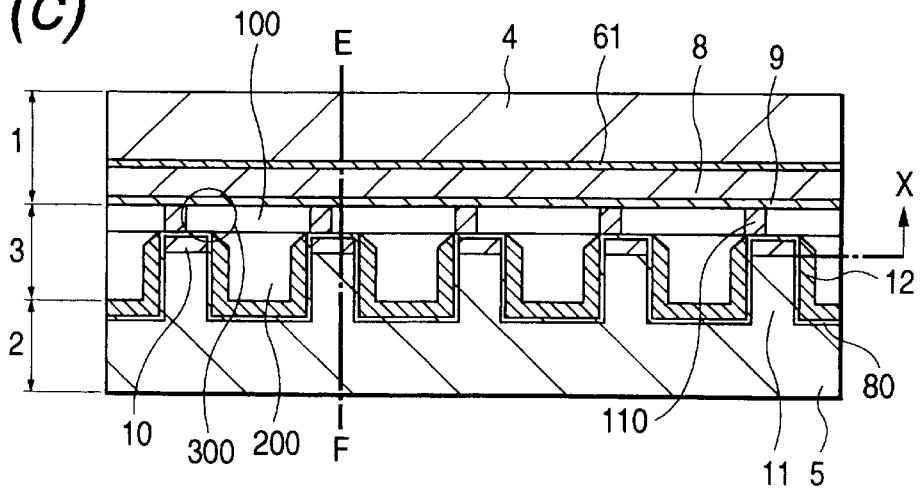

A fourth embodiment according to the present invention will be explained with reference to FIGS. 7(*a*), 7(*b*), 7(*c*) and FIG. 8(*a*), which are cross sectional views of a portion of a gas discharging type display device to which the present invention is applied. FIG. 7(*a*) shows a cross section in parallel with the address electrodes, FIG. 7(*b*) shows a cross section taken along line A-B shown in FIG. 7(*a*), which is transverse to the address electrodes, and FIG. 7(*c*) shows a cross section taken along line C-D shown in FIG. 7(*a*), which is transverse to the address electrodes. FIG. 7(*a*) illustrates a cross section taken along line E-F shown in FIG. (*b*) and FIG. 7(*c*).

Figure 8A:
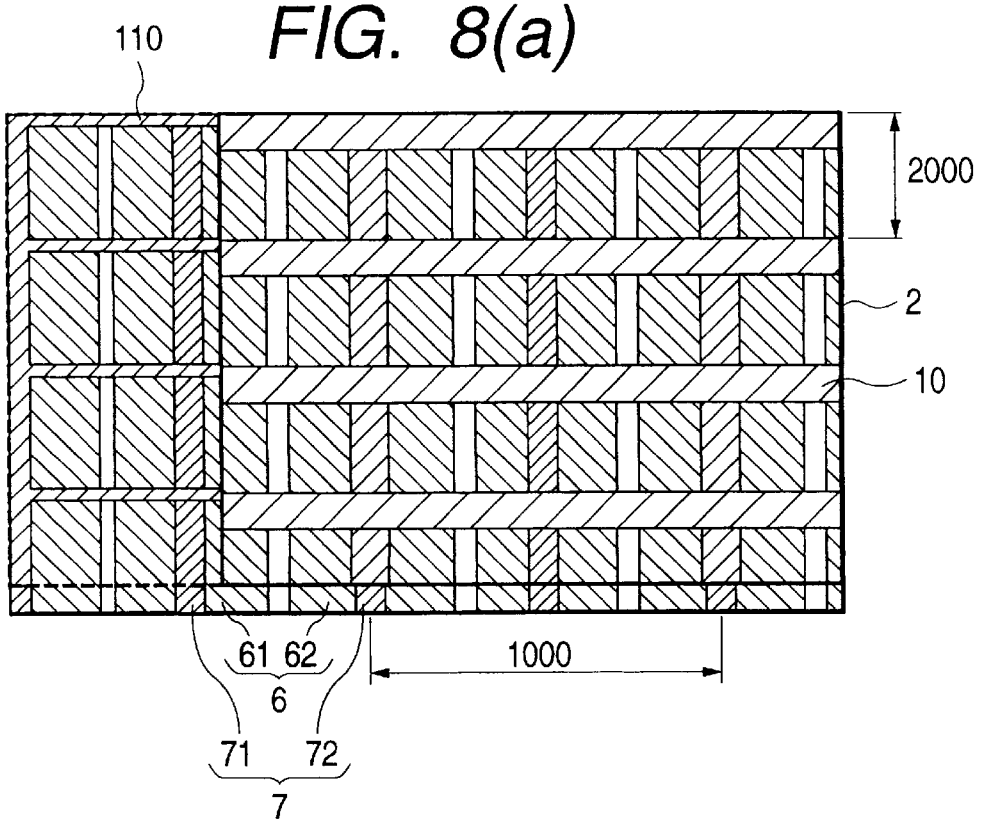
FIG. 8(*a*) is a diagrammatic view illustrating a positional relationship between the address electrodes and the barrier ribs on the side of a front substrate, and the display electrodes and the bus electrodes in the fourth embodiment as viewed from the direction X in FIG. 7(*a*).
Figure 8B:
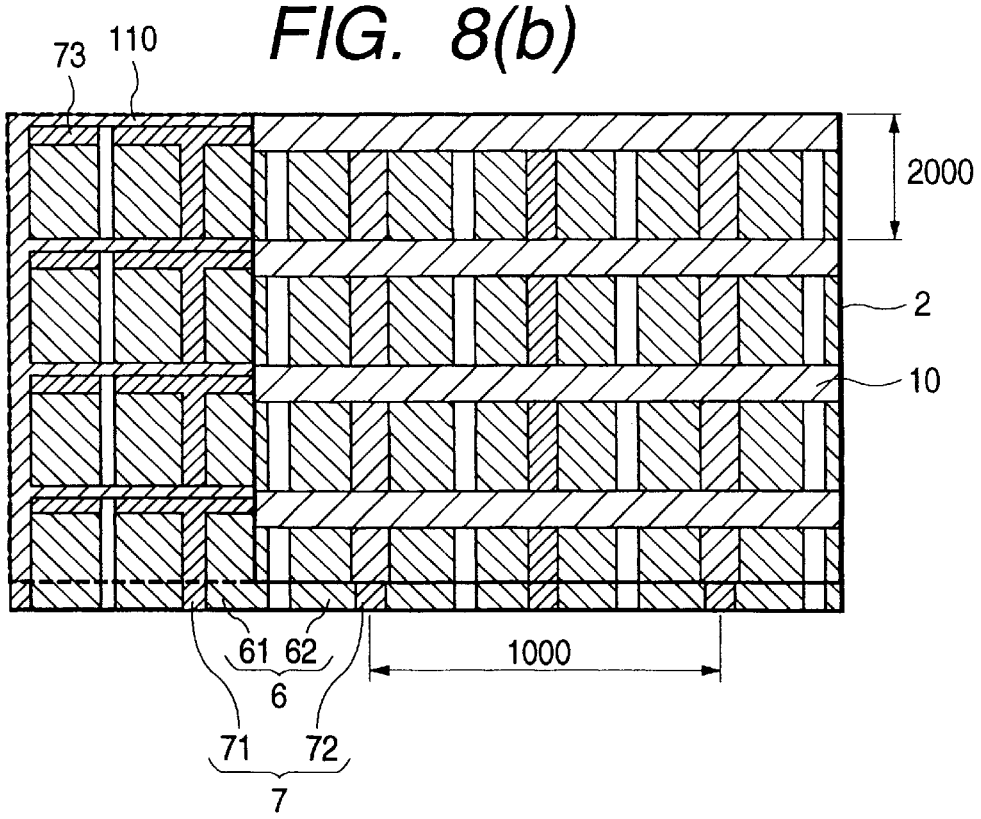

FIG. 8(*a*) is a diagrammatic view illustrating a positional relationship between the address electrodes, and the barrier ribs on the side of the front substrate, and the display electrodes and the bus electrodes disposed on the front substrate of the fourth embodiment as viewed in the direction X shown in FIG. 7(*a*). A portion in the figure surrounded with a heavy solid line is a view of the front substrate from just beneath the address electrodes 10 formed on the back substrate 2, a portion surrounded by a dotted line is a view of the front substrate from just beneath the barrier ribs 110 on the side of the front substrate and the remaining portion shows the display electrodes 6 and the bus electrodes 7 disposed on the front substrate 1. While the drawing is not a cross sectional view, the display electrodes 6, the bus electrodes 7, the barrier ribs 110 on the side of the front substrate and the address electrodes 10 are hatched, and the dielectric layer 8 and the protection layer 9 formed on the front substrate are not illustrated, for ease in understanding.

As can be seen from FIG. 7(*a*) and FIG. 8(*a*), this embodiment is different from the first embodiment and the third embodiment in that one display electrode 61 acting as an inherent electrode to the display electrode cell row and two display electrodes acting as a common electrode in the main discharge for conducting the display are provided corresponding to the main discharging space 100 for each of the display cells, and the display electrode 62 acting as the common electrode is used in common for adjacent display electrode cell rows. The bus electrode 72 on the display electrode 62 is desirably disposed so as to overlap with the barrier rib 110 forming the discharging space on the side of the front substrate in order to prevent a reduction in the degree of opening in the display cell. Further, in this embodiment, while the display electrode 62 is constituted as a common electrode riding over adjacent display electrode cell rows, it is not essential for the electrode 62 to over-ride in this way, but it may suffice for the bus electrode 72 to over-ride adjacent display electrode cell rows. Further, it is not required also for the display electrodes 61 on both sides of the bus electrode 71 to be connected beneath the bus electrode 71, since it may suffice for this electrode to be connected to the bus electrode 71.

This embodiment is identical with the first embodiment and the third embodiment in general structure arrangement, manufacturing method and features applicable to the present invention, except for the display electrode, and so the same effects as those in the first embodiment and the third embodiment can be attained. Further, when this embodiment is compared with the first embodiment and the third embodiment, the opening degree is made larger by the difference of the structure of the display electrodes 6 and bus electrodes 7, thereby obtaining higher brightness than in the case of the first embodiment and the third embodiment. It is apparent that this can even further increase the contrast on the display screen as compared to that in the first embodiment and the third embodiment.

Further, in this embodiment, the display electrode 61 inherent to the display electrode cell row 1000 is disposed at the center of the display cell to generate a main discharge for display between it and two common electrodes 62 on both sides thereof. That is, since two main discharges are generated by two sets of electrodes in the main discharging space 100 of each of the display cells, the intensity of UV-rays generated by the main discharge is increased, so that the amount of light emission from the fluorescent layer 12 can be increased to improve the brightness and the contrast as compared with the first embodiment and the third embodiment.

Further, also in this embodiment, as shown in FIG. 8(*b*), it is desirable to dispose a branched portion 73 of the non-transparent bus electrode having low resistance at locations where the address electrodes 10 and the display electrodes 6 intersect. In this case, the advantageous effects of improving the contrast on the display screen and lowering the resistance of the bus electrodes 7 can be obtained in the same manner as in the second embodiment.

In this embodiment, the address discharge is generated between a display electrode 61 (bus electrode 71) inherent to the display electrode cell row and an address electrode 10, but the discharge may also be generated between a display electrode 62 (bus electrode 72) acting as a common electrode in the main discharge and an address electrode 10.

Embodiment 5

Figure 9A:
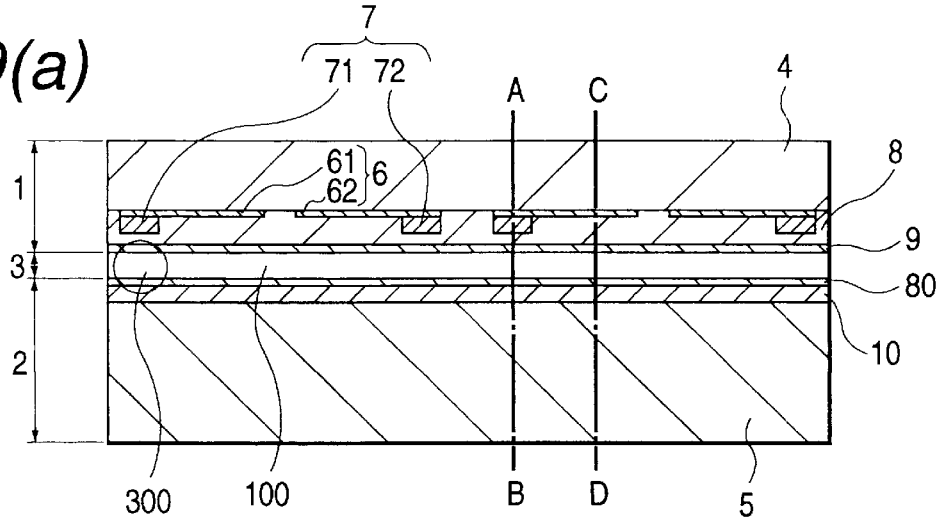
FIG. 9(*a*) is a cross sectional view of a gas discharging type display device taken in parallel with the address electrodes and illustrating a fifth embodiment according to the present invention.
Figure 9B:
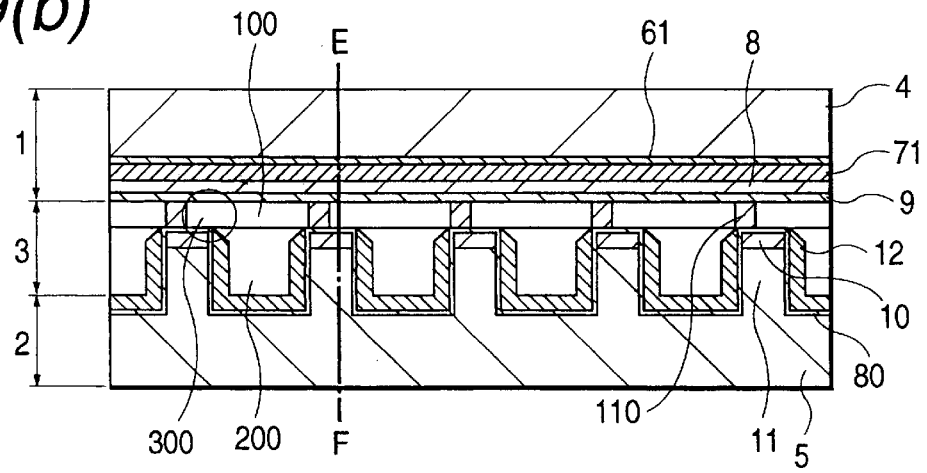
Figure 9C:
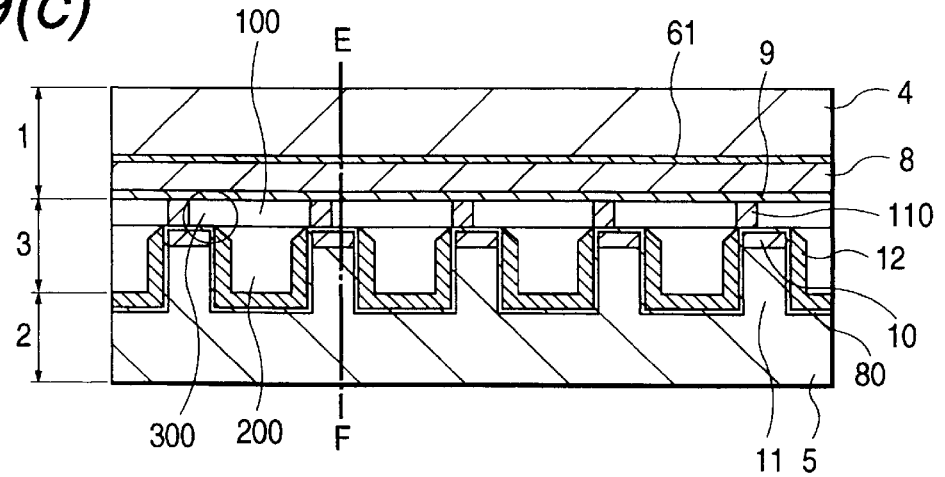

A fifth embodiment according to the present invention will be explained with reference to FIGS. 9(*a*), 9(*b*) and 9(*c*), which are cross sectional views of a portion of a gas discharging type display device to which the present invention is applied. FIG. 9(*a*) shows a cross section in parallel with the address electrodes, FIG. 9(*b*) shows a cross section taken along line A-B shown in FIG. 9(*a*) which is transverse to the address electrodes and FIG. 9(*c*) shows a cross section taken along line C-D shown in FIG. 9(*a*), which is transverse to the address electrode. FIG. 9(*a*) illustrates a cross section taken along line E-F shown in FIG. 9(*b*) and FIG. 9(*c*).

As can be seen from FIG. 9(*a*), this embodiment is different from the first embodiment in that the barrier rib 110 forming the discharging space on the side of the front substrate comprising the main discharging space 100 and the address discharging space 300 is extended in the extending direction of the address electrodes 10, and the discharging space on the side of the front substrate is constituted as a stripe-shape space like that the discharging space 200 on the side of the back substrate. The general structural arrangement, manufacturing method and features applicable to the present invention are otherwise identical with those in the first embodiment.

As apparent from the foregoing, this embodiment can attain the same effects as those in the first embodiment. Further, since the discharging space on the side of the front substrate is stripe-shaped and forms a discharging space extending in the same direction together with the discharging space 200 on the side of the back substrate of identical stripe shape, this can provide an effect of facilitating evacuation and sealing of a discharging gas after assembling the gas discharging type display device. However, as compared with the third and the fourth embodiments, the opening degree is lower due to the pattern shape of the display electrodes 6 and the bus electrodes 7 and is poor in brightness and contrast. Further, since separation between the address electrode cell rows is effected only by the distance between the display electrodes, there is a limit to how much the distance between adjacent address electrode cell rows can be reduced without incurring disadvantages in the refinement compared with the first to fourth embodiments.

Further, also in this embodiment, like that in the second embodiment, it is desirable to dispose a branched portion 73 of the non-transparent bus electrode having a low resistance at locations where the address electrodes 10 and the display electrodes 6 intersect. In this case, the advantageous effects of improving the contrast on the display screen and lowering the resistance of the bus electrodes 7 can be obtained in the same manner as in the second embodiment.

In this embodiment, an address discharge is generated between a display electrode 61 (bus electrode 71) inherent to the display electrode cell row and an address electrode 10, but the discharge may also be generated between a display electrode 62 (bus electrode 72) acting as a common electrode in the main discharge and an address electrode 10.

Embodiment 6

Figure 10A:
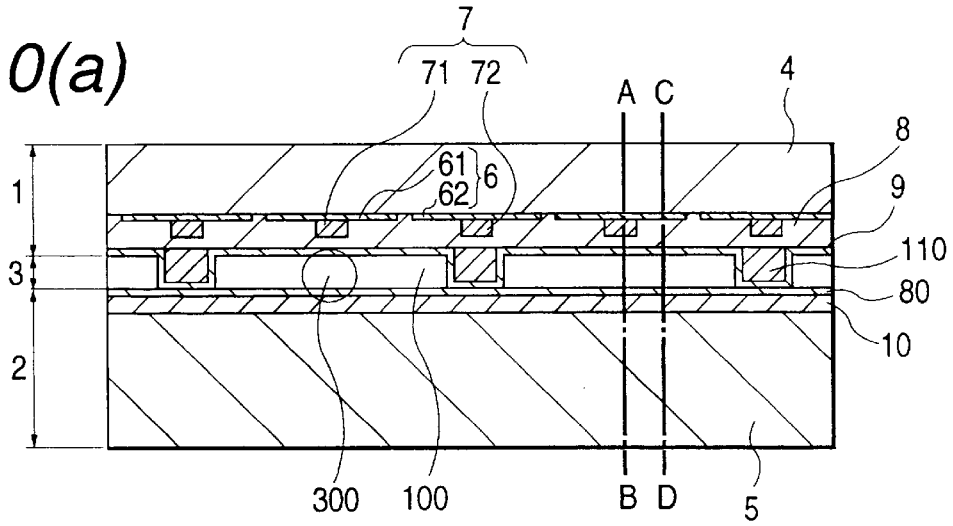
FIG. 10(*a*) is a cross sectional view of a gas discharging type display device taken in parallel with the address electrodes and illustrating a sixth embodiment according to the present invention.
Figure 10B:
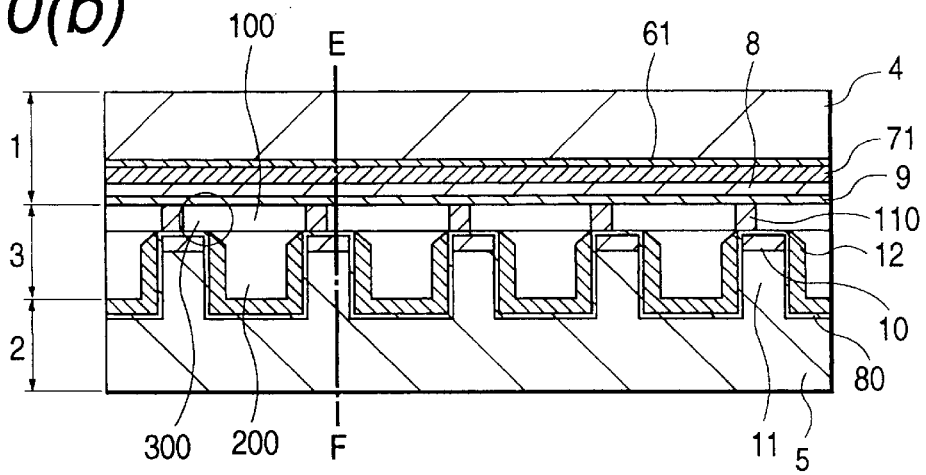
Figure 10C:
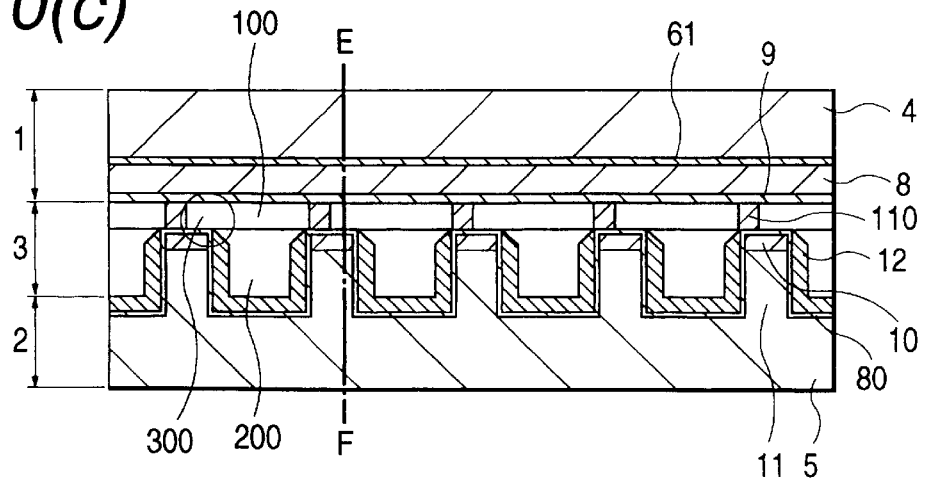

A sixth embodiment according to the present invention will be explained with reference to FIGS. 10(*a*), 10(*b*) and 10(*c*), which are cross sectional views of a portion of a gas discharging type display device to which the present invention is applied. FIG. 10(*a*) shows a cross section in parallel with the address electrodes, FIG. 10(*b*) shows a cross section taken along line A-B shown in FIG. 10(*a*), which is transverse to the address electrodes, and FIG. 10(*c*) shows a cross section taken along line C-D shown in FIG. 10(*a*), which is transverse to the address electrodes.

FIG. 10(*a*) illustrates a cross section taken along line E-F shown in FIG. 10(*b*) and FIG. 10(*c*).

As can be seen from FIG. 10(*a*), this embodiment is different from the fourth embodiment in that the a lattice-like barrier rib 110 forming a discharging space on the side of the front substrate comprising the main discharging space 100 for generating the main discharge for display and the address discharging space 300 for generating the address discharge for selecting the display cell is disposed directly on the side of the front substrate 1. The general structure arrangements, manufacturing method and features applicable to the present invention are otherwise identical with those in the fourth embodiment.

Figure 25:
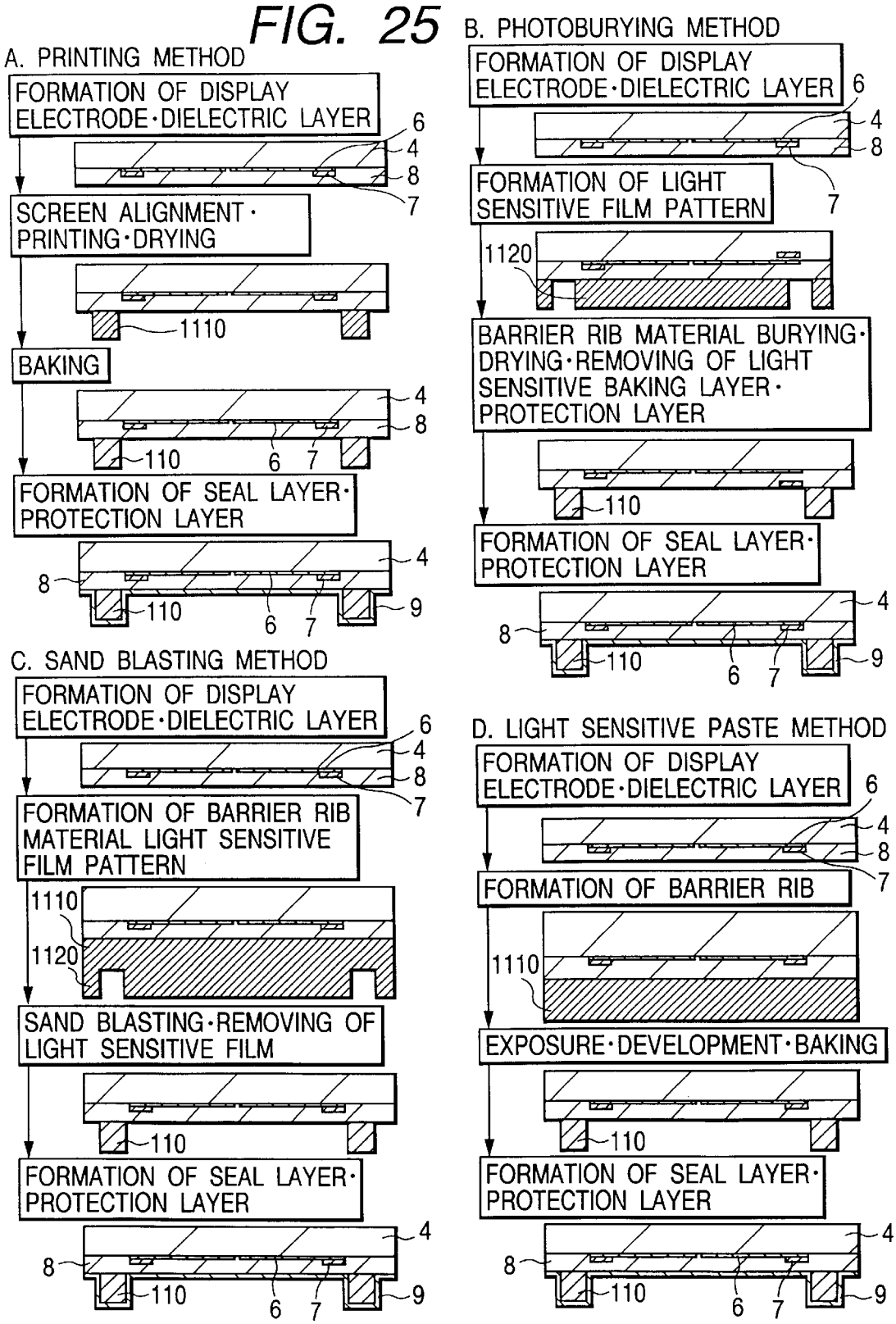
FIG. 25 is a step flow chart illustrating an example of a manufacturing method of a front substrate for the sixth embodiment according to the present invention.

Four examples of a manufacturing method for the front substrate 1 having a lattice-like barrier rib 110, different from the fourth embodiment, will be explained with reference to FIG. 25.

(A) Printing Method

At first, on the front glass substrate 4 on which the display electrode 6, the bus electrode 7 and the dielectric layer 8 are formed, a barrier rib material 1110 is printed by screen printing and then dried and baked to prepare a barrier rib 110. Then, a seal layer (not illustrated) is formed by a thick-film printing method and dried. Then, MgO as the protection layer 9 is formed by using a method, for example, of electron beam vapor deposition. Thus, the front substrate 1 having the barrier ribs 110 formed by using the thick-film printing method is completed.

(B) Photo-burying Method

A predetermined light sensitive film pattern 1120 is formed on the front glass substrate 4 on which the display electrode 6, the bus electrode 7 and the dielectric layer 8 are formed. Then, a barrier rib material is buried by a method, for example, of thick-film printing, dried and then removed with the light sensitive film 1120. Subsequently, the barrier rib 110 is formed by baking. Then, a seal layer (not illustrated) is formed by a thick-film printing method and dried. Then, MgO as the protection layer 9 is formed by using a method, for example, of electron beam vapor deposition. Thus, the front substrate 1 having the barrier ribs 1 formed by the photo-burying method is completed.

(C) Sand Blasting Method

At first, a barrier rib material 1110 is formed on the front glass substrate 4 on which the display electrode 6, the bus electrode 7 and the dielectric layer 8 are formed. After forming a predetermined pattern by using a light sensitive film 1120, the barrier rib material 1110 at a portion not covered with the light sensitive film 1120 is removed by sand blasting. Then, the light sensitive film 1120 is removed and baking is applied to form the barrier rib 110. Then, a seal layer (not illustrated) is formed by a thick-film printing method and dried. Subsequently, MgO as the protection layer 9 is formed by using, for example, electron beam vapor deposition. Thus, the front substrate 1 having the barrier ribs 110 formed by using sand blasting is completed.

(D) Light Sensitive Paste Method

At first, a barrier rib material 1110 provided with photosensitivity is formed on the front glass substrate 4 on which the display electrode 6, the bus electrode 7 and the dielectric layer 8 are formed. Then, after forming a predetermined barrier rib pattern by each of the steps of a well-known exposure, development and drying process, baking is applied to form the barrier ribs 110. Then, a seal layer (not illustrated) is formed by a thick-film printing method and dried. Subsequently, MgO as the protection layer 9 is formed by using, for example, electron beam vapor deposition. Thus, the front substrate 1 having the barrier ribs 110 formed by using a light sensitive paste is completed.

Figure 22:
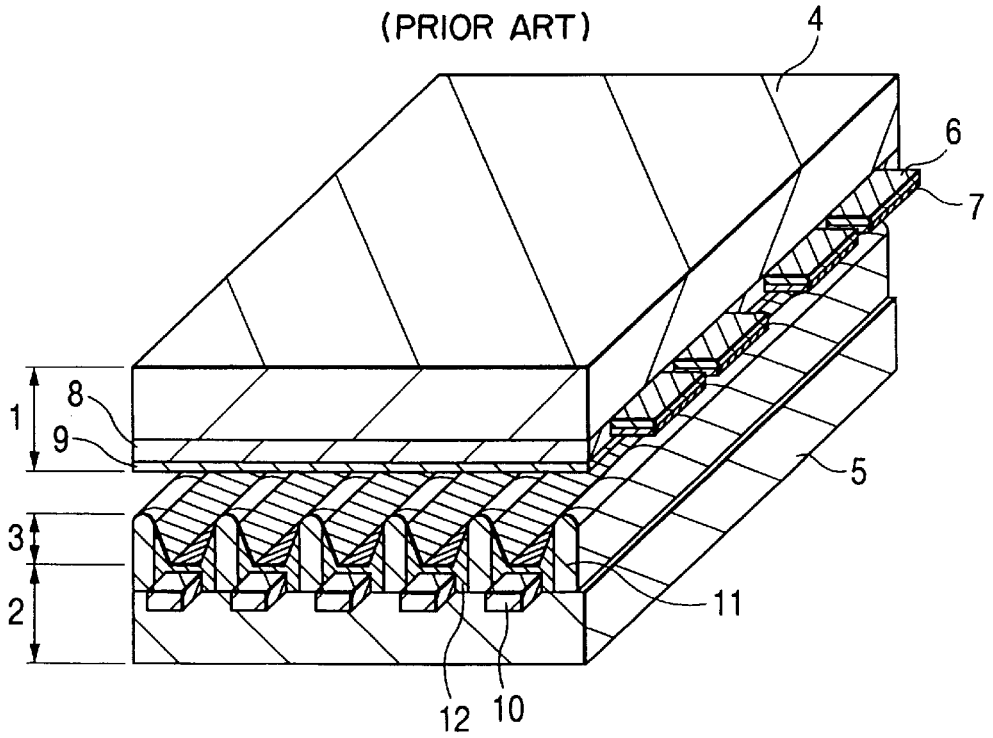
FIG. 22 (PRIOR ART)
FIG. 22 is a perspective view illustrating the general construction of a gas discharging type display panel.
Figure 23A:
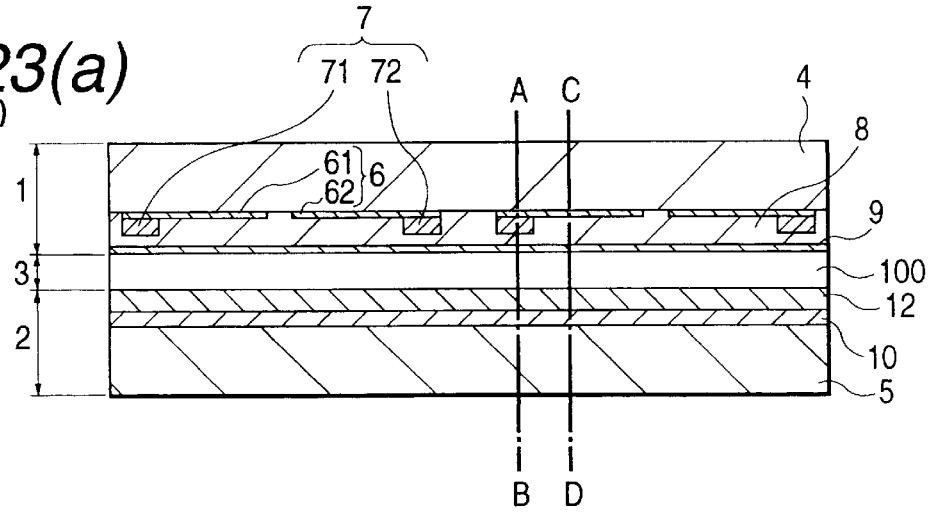
FIG. 23(a) (PRIOR ART)
FIG. 23(*a*) is a cross sectional view in the direction of the address line illustrating a gas discharging type display panel.
Figure 23B:
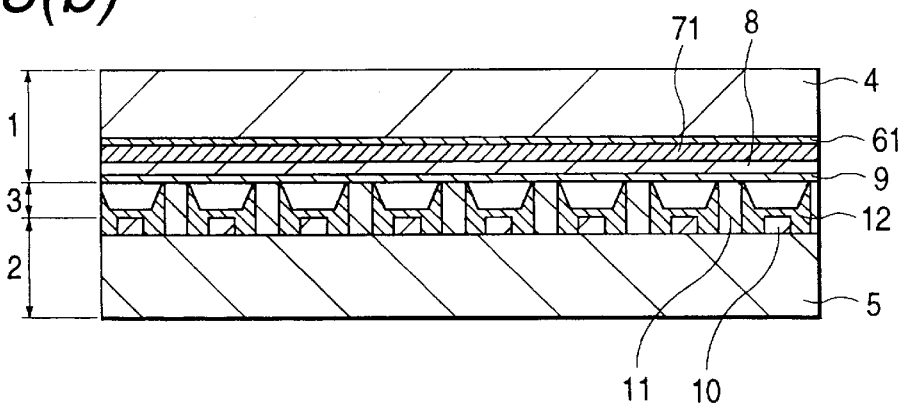
FIG. 23(b) (PRIOR ART)
Figure 23C:
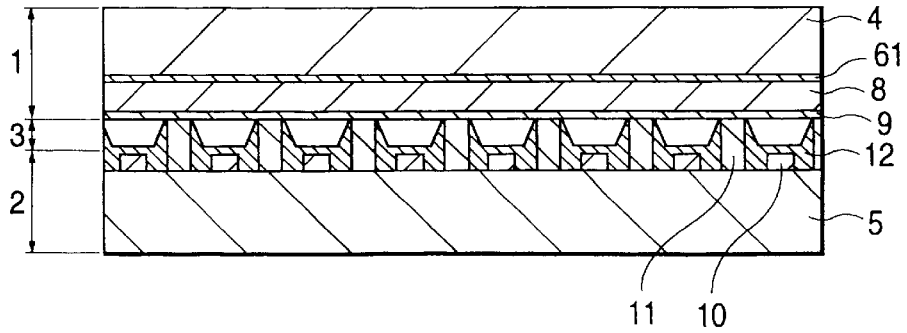
FIG. 23(c) (PRIOR ART)

The manufacturing method for the barrier rib 110 for forming the discharging space on the side of the front substrate is identical with the standard manufacturing method for the barrier ribs 11 of the gas discharging type display device shown in FIG. 22 and FIG. 23. However, in a case of the standard gas discharging type display device, since it is necessary to ensure that a discharging space sufficient for stable discharge and a space sufficient for forming a required amount of the fluorescent layer are provided, the height of the barrier rib 11 has to be increased, which makes the manufacturing process difficult. On the contrary, in this embodiment to which the present invention is applied, since the voltage applied to the address electrodes 10 for generating the address discharge and the voltage applied to the display electrodes 6 (or bus electrodes) is lowered, the height of the barrier rib 110 is not increased. For example, the height of the barrier rib is from 0.15 to 0.2 mm in the standard gas discharging type display device, whereas the height is from 0.05 to 0.1 mm in this embodiment, which is less than ½ of that of the standard device. This indicates that the manufacturing method of this embodiment is facilitated compared with the prior art.

This embodiment is identical with the fourth embodiment with respect to the constitution of the barrier ribs 110 for forming the discharging space on the side of the front substrate, manufacturing method and applicable features of the present invention and can obtain identical effects with those of the fourth embodiment.

Further, also in this embodiment, like that in the second embodiment, it is desirable to dispose a branched portion 73 of the non-transparent bus electrode having a low resistance at locations where the address electrodes 10 and the display electrodes 6 intersect. In this case, the advantageous effects of improving the contrast on the display screen and lowering the resistance of the bus electrodes 7 can be obtained in the same manner as in the second embodiment.

In this embodiment, the address discharge is generated between a display electrode 61 (bus electrode 71) inherent to the display electrode cell row and an address electrode 10, but the discharge may also be generated between a display electrode 62 (bus electrode 72) acting as a common electrode in the main discharge and an address electrode 10.

Further, although the structure of the display electrodes 6 and the bus electrodes 7 is identical with that of the fourth embodiment, the structure thereof is not restricted only to that described, but may be made identical with that of the first and the third embodiments. In this case, the same effects as those obtained in the first and the third embodiments can be obtained.

Further, in this embodiment, the barrier ribs 110 are formed in a lattice shape for partitioning the main discharging space 100 for each of the display cells. However, the shape of the barrier ribs 110 is not restricted only thereto, but a stripe-shape barrier rib extending in the extending direction of the address electrodes 10 may be used like that in the fifth embodiment. In this case, the effects obtained in the fifth embodiment can be obtained.

Embodiment 7

Figure 11A:
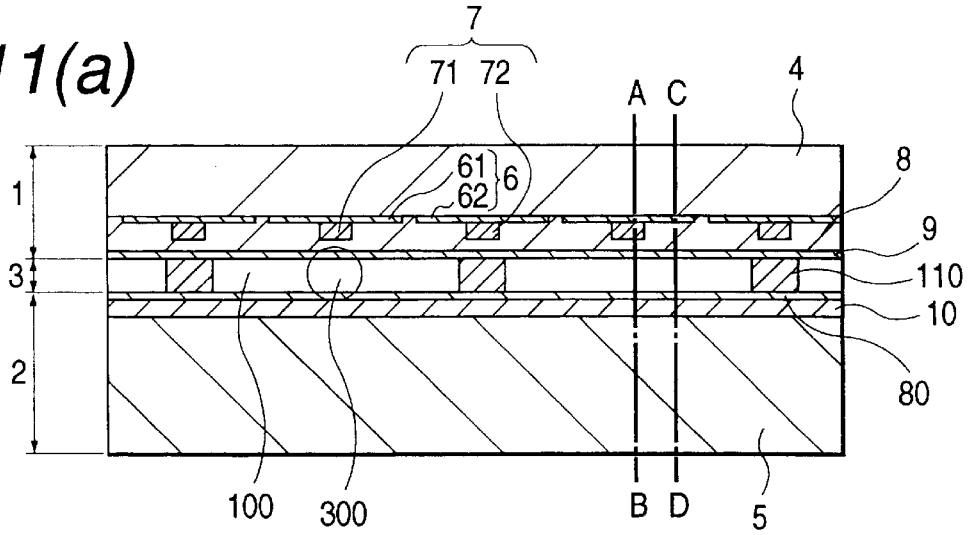
FIG. 11(*a*) is a cross sectional view of a gas discharging display device taken in parallel with the address electrodes and illustrating a seventh embodiment according to the present invention.
Figure 11B:
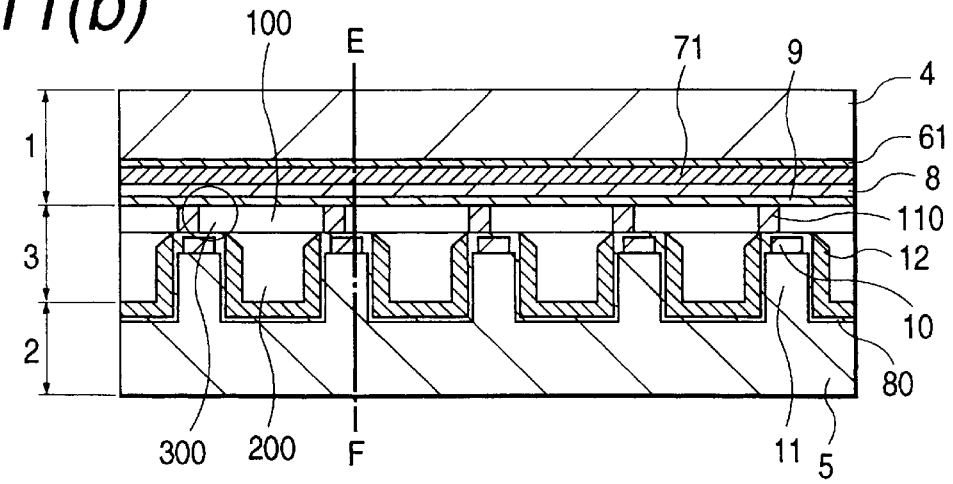
Figure 11C:
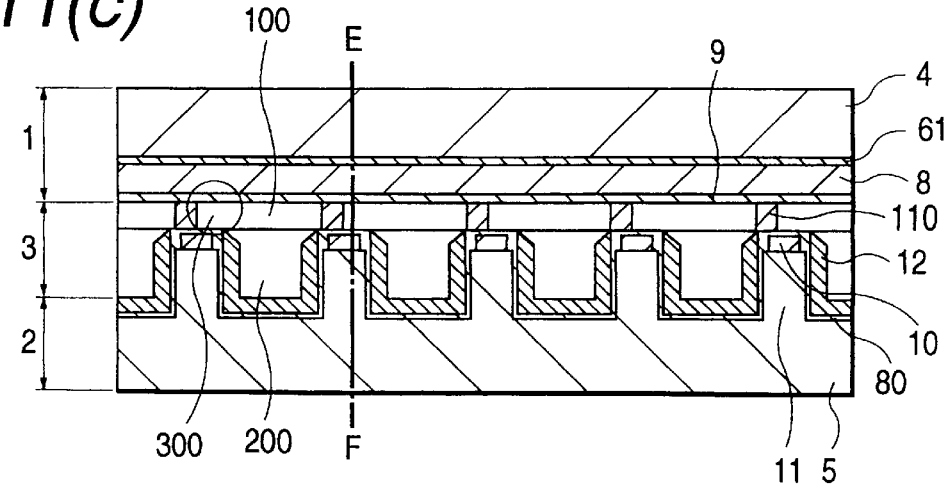
Figure 26:
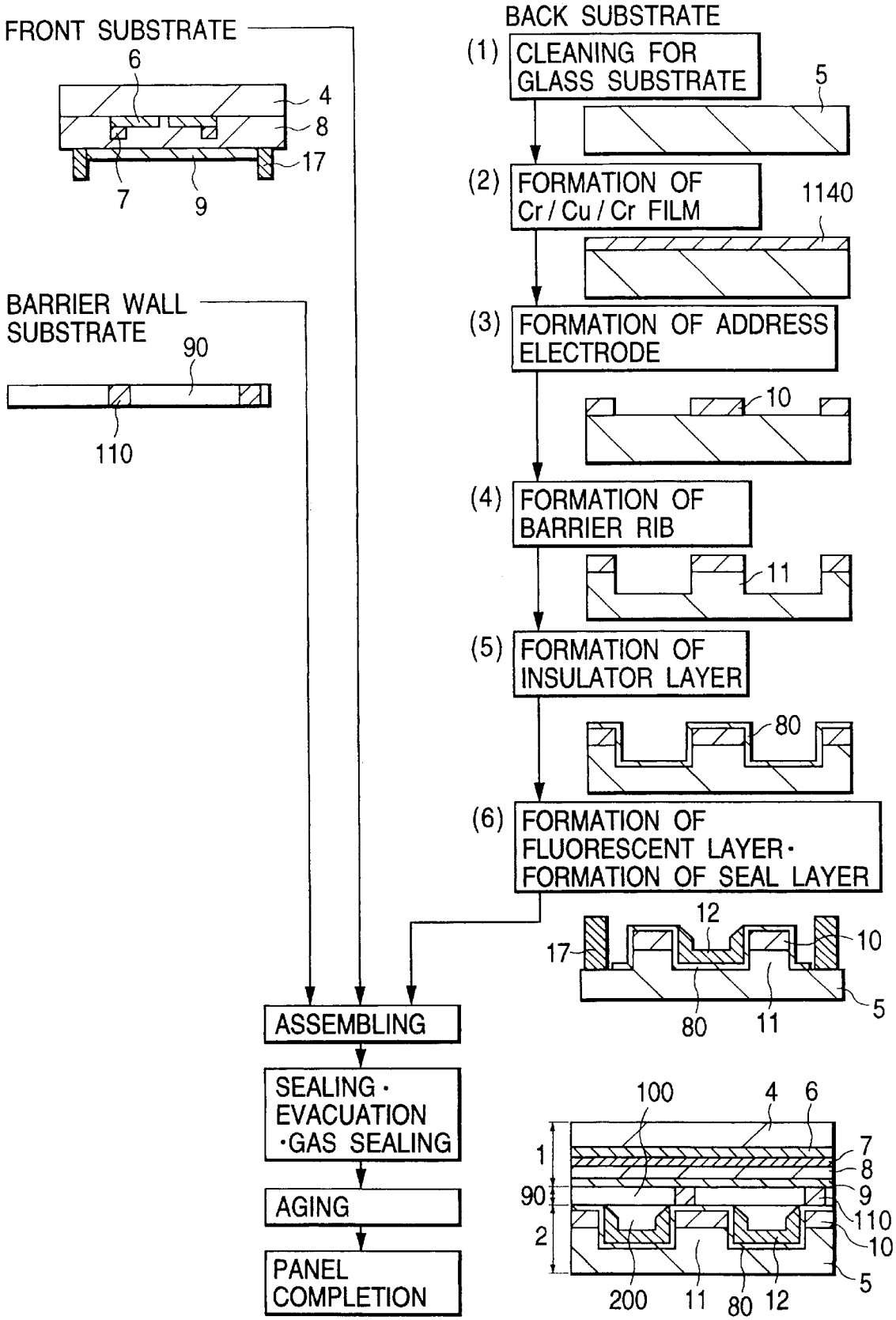
FIG. 26 is a step flow chart illustrating an example of a manufacturing method for the seventh embodiment according to the present invention.

A seventh embodiment according to the present invention will be explained with reference to FIGS. 11(*a*), 11(*b*), 11(*c*) and FIG. 26. FIGS. 11(*a*), 11(*b*) and 11(*c*) are cross sectional views of a portion of a gas discharging type display device to which the present invention is applied. FIG. 11(*a*) shows a cross section in parallel with the address electrodes, FIG. 11(*b*) shows a cross section taken along line A-B shown in FIG. 11(*a*), which is transverse to the address electrodes, and FIG. 11(*c*) shows a cross section taken along line C-D shown in FIG. 11(*a*) which is transverse to the address electrodes. FIG. 11(*a*) illustrates a cross section taken along line E-F shown in FIG. 11(*b*) and FIG. 11(*c*). FIG. 26 is a step flow chart showing one example of a manufacturing method for the seventh embodiment.

Comparing FIG. 11(*a*) and FIG. 7(*a*), this embodiment is different from the fourth embodiment in that the pattern width of the address electrodes 10 formed on the barrier ribs 11 forming the discharging space 200 on the side of the back substrate is made smaller than the width of the barrier ribs 11. However, the feature of this embodiment does not specifically reside in the structure of the back substrate 2, but concerns the manufacturing method for the back substrate. That is, the constitution of this embodiment and the applicable features of the invention are substantially identical with those in the fourth embodiment.

An example of the manufacturing method for the seventh embodiment will be explained with reference to FIG. 26.

(1) A back glass substrate 5 comprising, for example, soda lime glass, is cleaned by using, for example, a neutral detergent.

(2) A Cr/Cu/Cr laminate film 1140 is formed on the cleaned back glass substrate 5 by using a film forming method, for example, sputtering or electron beam vapor deposition.

(3) The Cr/Cu/Cr laminate film is fabricated by using a well-known photoetching process to prepare an electrode pattern of the address electrodes 10. The thickness of the Cu film and the pattern size of the address electrodes 10 may be determined depending on the resistance value required for the address electrodes.

(4) A predetermined pattern is formed by using a light sensitive film on the back glass substrate 5 provided with the address electrodes 10. Then, sand blasting is applied and a portion of the back glass substrate 5 not covered with the light sensitive film is engraved to form barrier ribs 11 partitioning the discharging space 200 on the side of the back substrate. Then, the light sensitive film is removed by a well-known method.

(5) A hydrolyzable coating agent mainly composed of Al, Si and O (alkoxide, etc.) is coated, for example, by blading or spraying to a predetermined area of the back glass substrate 5 on which the address electrodes 10 and the barrier ribs 11 are formed and the coating is heated at a temperature of 100 to 400° C. for 1 to 60 min, thereby forming an insulator layer 80 of 0.002 to 0.005 mm.

(6) A fluorescent layer 12 is coated on the inner wall of the barrier ribs 11 forming the discharging space 200 on the side of the back substrate, for example, by spraying or blading. In the case of a gas discharging display device for color display, fluorescent layers 12 emitting colors of green, blue and red are coated by aligning masks of predetermined patterns for green, blue and red. Then, a heat treatment is applied at a temperature from 150 to 300° C. for 5 to 60 min. Further, a pattern of frit glass is formed by using, for example, a thick-film printing method, and the result is dried to form a seal layer 17 for vacuum sealing.

By the steps described above, the back substrate 2 having barrier ribs 11 partitioning the discharging space 200 on the side of the back substrate is completed. The back substrate 2 is provided with a tip tube (not illustrated) for exhaustion and gas introduction after panel assembling.

The back substrate 2 prepared by the steps described above, the front substrate 1 prepared in the same manner as in the first embodiment and the barrier wall substrate are aligned and the substrates are secured by a heat treatment at 300 to 450° C. Then, the discharging space defined between the front substrate 1 and the back substrate 2 is evacuated through the tip tube (not illustrated) disposed in the back substrate and, for example, Ne containing 3% Xe is introduced into the discharging space between the front substrate 1 and the back substrate 2, and the pressure in the discharging space is adjusted to 35 to 70 kPa. Then, the tip tube (not illustrated) is locally heated to seal it off, to complete the gas discharging type display device shown in FIG. 11(*a*).

This embodiment is identical with the fourth embodiment in structural arrangement and applicable features of the present invention, except for the manufacturing method for the back substrate 2, and so the same effects as those attained in the fourth embodiment can be realized.

Also in this embodiment, like that in the second embodiment, it is desirable to dispose a branched portion 73 of the non-transparent bus electrode having low resistance at locations where the address electrodes 10 and the display electrodes 6 intersect. In this case, the advantageous effects of improving the contrast on the display screen and lowering the resistance of the bus electrodes 7 can be obtained in the same manner as in the second embodiment.

In this embodiment, an address discharge is generated between a display electrode 61 (bus electrode 71) inherent to a display electrode cell row and an address electrode 10, but the discharge may also be generated between a display electrode 62 (bus electrode 72) acting as a common electrode in the main discharge and an address electrode 10.

Further, while the structure of the display electrodes 6 and the bus electrodes 7 is made identical with the fourth embodiment, the structure is not limited thereto, but may be identical with that in the first or third embodiment. In this case, the effect obtained in each of the first and the third embodiments can be obtained.

In this embodiment, the barrier ribs 110 dividing the main discharging space 100 on each of the display cells is formed with the barrier wall substrate 90. However, the method of forming the barrier ribs 110 is not restricted only thereto, since they may be formed directly on the front substrate 2 in the same manner as in the sixth embodiment.

Further, the insulator layer 80 on the address electrodes 10 is formed by using a hydrolyzable coating agent in this embodiment, but the material for the insulator layer 80 is not limited only thereto. Further, the method of forming the insulator layer 80 is not restricted to the combination of blading or spraying and heat setting used in this embodiment, but sputtering, vacuum vapor deposition, such as electron beam vapor deposition, chemical vapor phase deposition or thick-film printing or the like may be used. Further, if the consumption by the discharge of the insulator layer 80 is violent, it is desirable to form the insulator layer 80 with a material of excellent sputtering resistance to the discharging gas, for example, MgO.

Embodiment 8

Figure 12A:
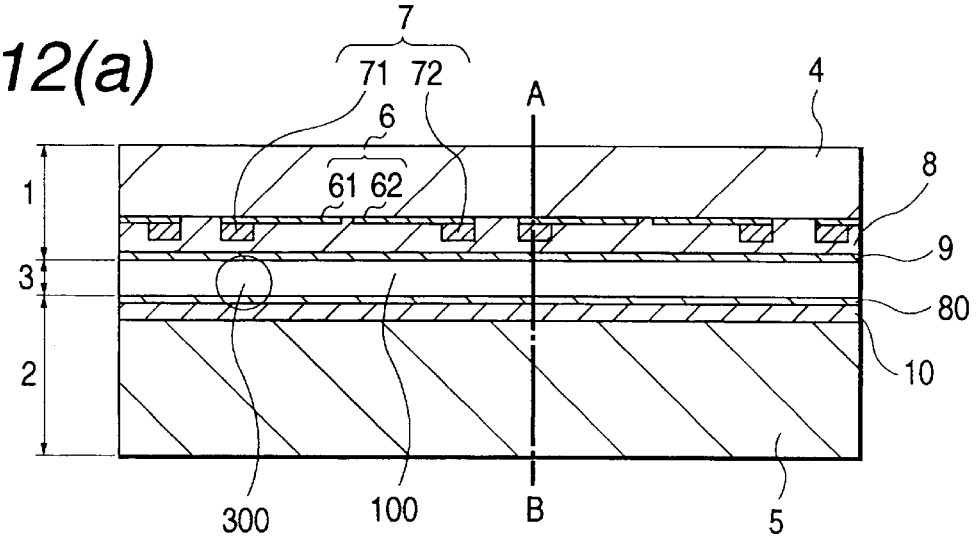
FIG. 12(*a*) is a cross sectional view of a gas discharging type display device taken in parallel with the address electrodes and illustrating an eighth embodiment according to the present invention.
Figure 12B:
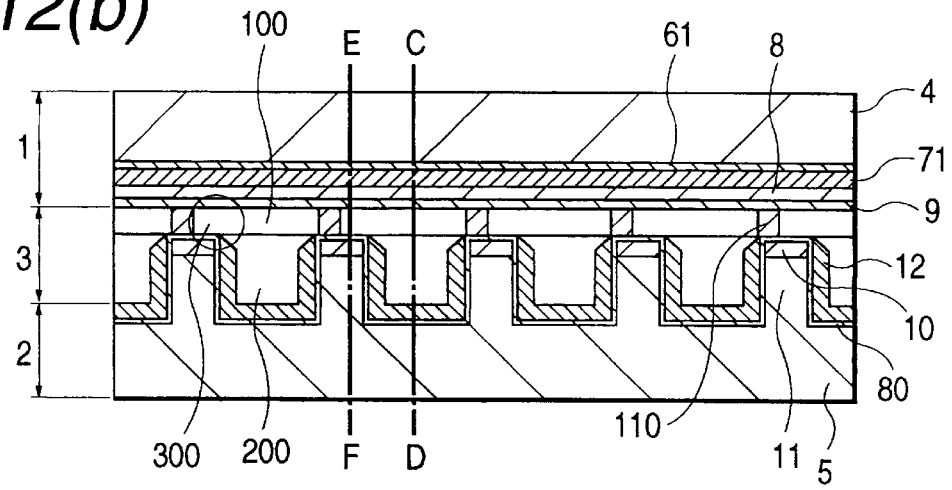
Figure 12C:
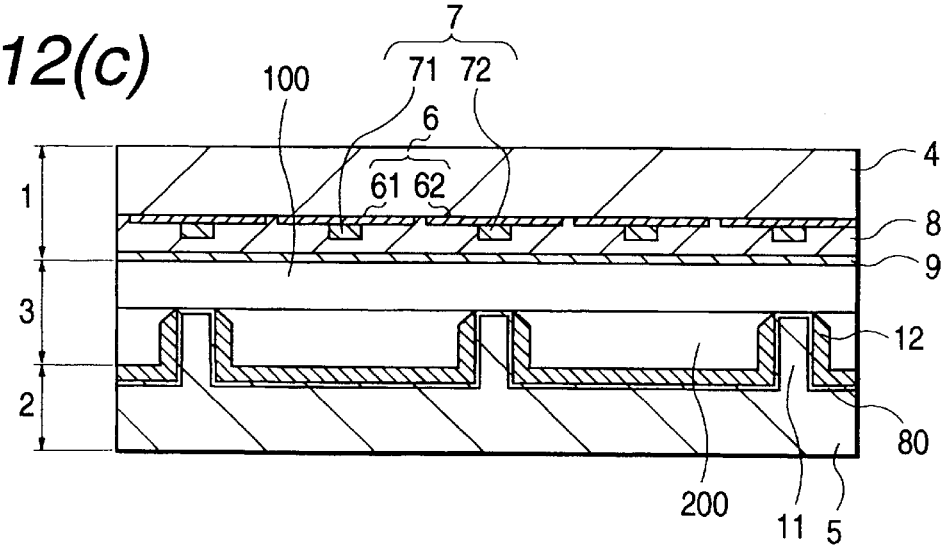

An eighth embodiment according to the present invention is to be explained with reference to FIGS. 12(*a*), 12(*b*) and 12(*c*), which are cross sectional views of a portion of a gas discharging type display device to which the present invention is applied. FIG. 12(*a*) shows a cross section in parallel with the address electrodes, FIG. 12(*b*) shows a cross section taken along line A-B shown in FIG. 12(*a*), which is transverse to the address electrodes and FIG. 12(*c*) shows a cross section taken along line C-D shown in FIG. 12(*b*), which is vertical to the address electrodes. FIG. 12(*b*) illustrates a cross section taken along line E-F shown in FIG. 12(*b*).

As can be seen from comparison between FIGS. 12(*a*), 12(*c*) and FIG. 1(*a*), this embodiment is different from the first embodiment in that the discharging space on the side of the front substrate comprising the main discharging space 100 and the address discharging space 300 forms a stripe-shape space extending in the extending direction of the address electrodes 10, and the discharging space 200 on the side of the back substrate is formed by the barrier rib 11 as the space corresponding to each display cell. The fluorescent layer 12 is formed on the inner wall of the barrier ribs 11 on the side of the back substrate. In this embodiment, the discharging space 200 on the side of the back substrate is separated on every display cell, so that the address electrodes 10 and the barrier ribs 11 can not be formed by an identical process. That is, this embodiment can not be formed by the manufacturing method described with reference to the first embodiment, but it is necessary to adopt the manufacturing method for the seventh embodiment shown in FIG. 26.

The first feature of this embodiment of the present invention resides in the fact that the discharging space formed between the front substrate 1 and the back substrate 2 is constituted with a discharging space on the side of the front substrate comprising the main discharging space 100 for generating a main discharge for display and the address discharging space 300 for generating an address discharge for selecting the display cell, and a discharging space 200 on the side of the back substrate partitioned by the barrier ribs having the fluorescent layer 12 formed on the inner wall. The second feature of this embodiment of the present invention resides in the fact that the address discharging space 300 is formed by disposing the address electrodes 10 on the barrier ribs 11 for forming the discharging space 200 on the side of the back substrate and forming a space between the front substrate 1 and the address electrodes 10 by the barrier ribs 110 on the side of the front substrate. This makes it possible to adjust the address voltage for generating an address discharge by the height of the barrier rib on the side of the front substrate, and so the effect of the address discharge on the fluorescent layer 12 can be suppressed. The third feature of this embodiment of the present invention resides in forming only the fluorescent layer 12 on the inner wall of the barrier rib 11 forming the discharging space 200 on the side of the back substrate (in the standard discharging type display device, the address electrodes 10 and the fluorescent layer 12 are formed). The fourth feature of this embodiment of the present invention resides in the fact that the barrier rib 11 forming the discharging space 200 on the side of the back substrate is formed with a portion of the back glass substrate 5. This makes it possible to easily form the address electrodes 10 on the barrier ribs 11 for forming the discharging space 200 on the side of the back substrate. A fifth feature of this embodiment of the present invention is to use, as a manufacturing method for the back substrate 2, steps shown in FIG. 26 for forming a pattern of address electrodes 10, and then forming the barrier ribs 11 for forming the discharging space 200 on the side of the back substrate. This can simplify the manufacturing of the back substrate compared with the prior art.

The advantageous effects obtained by this embodiment to which the present invention is applied, in comparison with the standard gas discharging type display device, will be summarized below.

(1) Since the distance between the address electrodes 10 and the display electrodes 6 (or bus electrodes 7) is reduced, the address voltage for generating the address discharge between the address electrodes 10 and the display electrodes 6 (or bus electrodes 7) can be lowered. The address voltage can be controlled depending on the height of the barrier ribs 110 on the side of the front substrate. For example, the address voltage can be lowered to ⅖ of that of the standard gas discharging type display device (about 0.2 mm distance between display electrodes 6 and the address electrodes 10) by reducing the distance to 0.08 mm between the display electrodes 6 and the address electrodes 10 for instance. This can eliminate the requirement for the auxiliary discharge of forming wall charges for reducing the address voltage, making it easy for providing gradation in the display on the display screen.

(2) As described in (1) above, since an auxiliary discharge for forming the wall charge in order to lower the address voltage is not required, and the address discharge is conducted in an address discharging space in which the fluorescent layer 12 is not present, the brightness in the black display state can be lowered to enhance the contrast.

(3) As described in (1) above, since an auxiliary discharge for forming the wall charge in order to lower the address voltage is not required and the fluorescent layer 12 is not present between the address electrodes 10 and the display electrodes 6 (or bus electrodes 7), ion damage by discharge to the fluorescent layer 12 can be suppressed. This can attain an improvement in the working life of the fluorescent layer 12.

(4) Since the barrier ribs 11 for forming the discharging space 200 on the side of the back substrate is disposed in a lattice-shape, the coating amount of the fluorescent layer 12 is improved and the brightness can be enhanced. This also leads to an improvement in the contrast.

(5) Since the barrier rib 11 can be formed at a temperature lower than the distortion point of soda lime glass, a deformation of the glass substrate can be suppressed and the improvement of the manufacturing yield can be expected.

(6) Since the barrier ribs 11 on the side of the back substrate for partitioning the discharging space can be formed by only engraving the base substrate, the back substrate 2 can be formed by a simplified manufacturing method and improvement in the yield can be obtained, as compared with the prior art described above.

As has been described above, the eighth embodiment of the present invention can provide a gas discharging type display device with lowered address voltage, even without forming the wall charges, having a high contrast on the display screen, and which is capable of suppressing ion damage on the fluorescent layer, and it is possible to provide advantageous effects capable of shortening the manufacturing steps and improving the yield in the manufacturing steps for the gas discharging type display device. Further, in this embodiment, like that in the second embodiment, it is desirable to dispose a branched portion 73 of the non-transparent bus electrodes having a low resistance at locations where the address electrodes 10 and the display electrodes 6 intersect. In this case, the effects of improving the contrast on the display screen and lowering the resistance of the bus electrodes 7 can be obtained in the same manner as in the second embodiment.

In this embodiment, an address discharge is generated between a display electrode 61 (bus electrode 71) inherent to a display electrode cell row and a address electrode 10, but the discharge may also be generated between a display electrode 62 (bus electrode 72) acting as a common electrode in the main discharge and an address electrode 10.

In this embodiment, the barrier ribs 110 forming the main discharging space 100 on the side of the front substrate is formed with a barrier wall substrate 90, but it may be formed directly on the front substrate 2 as in the sixth embodiment.

Embodiment 9

Figure 13A:
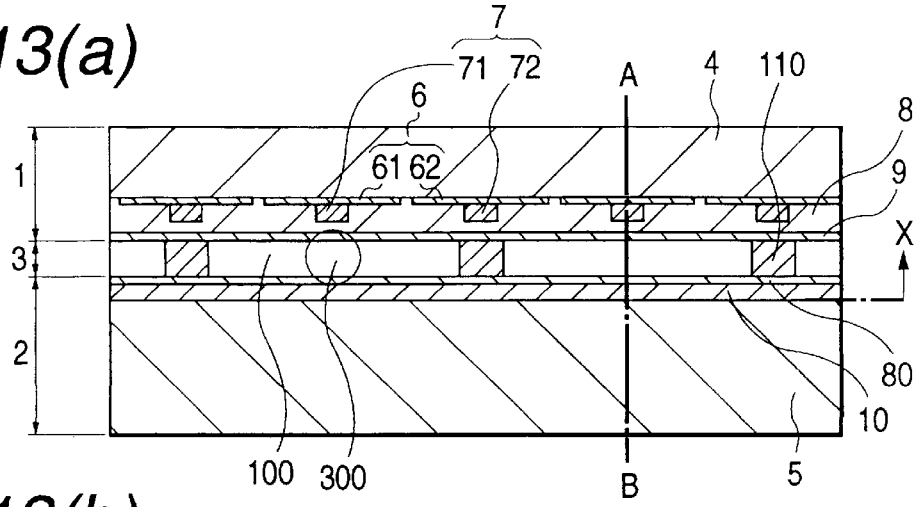
FIG. 13(*a*) is a cross sectional view of a gas discharging type display device taken in parallel with the address electrodes and illustrating a ninth embodiment according to the present invention.
Figure 13B:
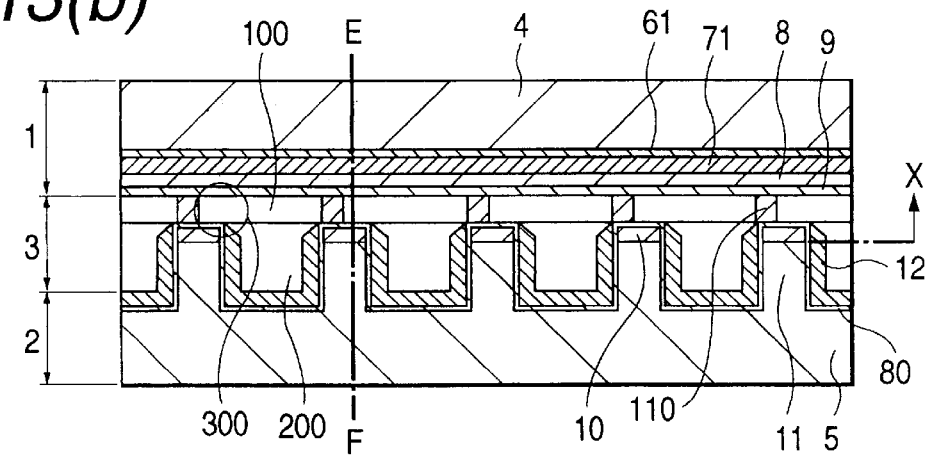
Figure 13C:
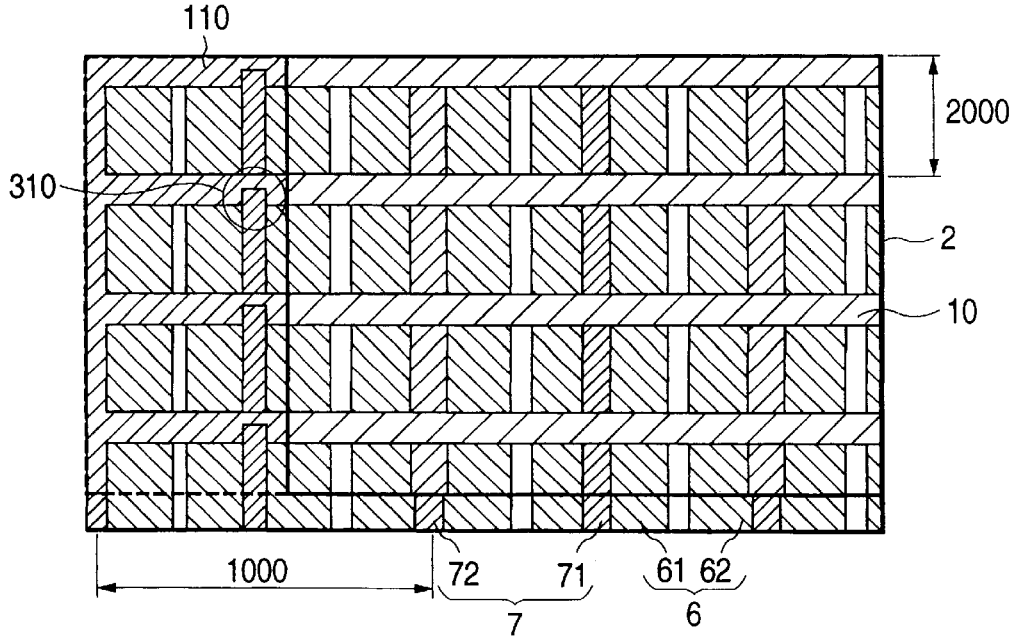

A ninth embodiment according to the present invention will be explained with reference to FIGS. 13(*a*), 13(*b*) and 13(*c*), which are cross sectional views of a portion of a gas discharging type display device to which the present invention is applied. FIG. 13(*a*) shows a cross section in parallel with the address electrodes, and FIG. 13(*b*) shows a cross section taken along line A-B shown in FIG. 13(*a*), which is transverse to the address electrodes. FIG. 13(*a*) illustrates a cross section taken along line E-F shown in FIG. 13(*b*). FIG. 13(*c*) is a diagrammatic view illustrating a positional relationship between the address electrodes, and the barrier ribs on the side of the front substrate, and the display electrodes and the bus electrodes disposed on the front substrate of the first embodiment, as viewed in the direction X shown in FIG. 13(*a*) and FIG. 13(*b*). A portion in FIG. 13(*c*) surrounded with a heavy solid line is a view of the front substrate from just beneath the address electrodes 10 formed on the back substrate 2, a portion surrounded by a dotted line is a view of the front substrate from just beneath the barrier rib 110 on the side of the front substrate and the remaining portion shows the display electrodes 6 and the bus electrodes 7 disposed on the front substrate 1. While FIG. 13(*b*) is not a cross sectional view, the barrier ribs 110 on the side of the front substrate, the display electrodes 6, the bus electrodes 7 and the address electrodes 10 are hatched, and the dielectric layer 8 and the protection layer 9 formed on the front substrate are not illustrated, for ease in understanding.

As can be seen from FIG. 13(*c*), this embodiment is different from the fourth embodiment in that an address discharge generated between a bus electrode 71 and an address electrode 10 is conducted by way of an opening 310 disposed in the barrier rib 110 forming the discharging space on the side of the front substrate. In this embodiment, the address discharge is conducted between the bus electrode 71 and the address electrode 10, but it may be conducted between the display electrode 61 and the address electrode 10. Except for conducting the address discharge by way of the opening 310 disposed to the barrier rib 110 forming the discharging space on the side of the front substrate, the structural arrangement manufacturing method and applicable features of the present invention are identical with those in the fourth embodiment. Accordingly, this embodiment can provide the same effects as those in the fourth embodiment. Further, the barrier ribs 110 on the side of the front substrate can function as a black mask shielding a portion at the periphery for each of the display cells that can not be controlled, and this effect appears intensely in this embodiment to improve the quality in the black display state.

Also, in this embodiment, like that in the second embodiment, it is desirable to dispose a branched portion of the non-transparent bus electrodes having a low resistance at locations where the address electrodes 10 and the display electrodes 6 intersect. In this case, since light emission from discharged gas by address discharge is shielded, the effects of improving the contrast on the display screen and lowering the resistance of the bus electrode 7 can be obtained in the same manner as in the second embodiment.

In this embodiment, an address discharge is generated between a display electrode 61 (bus electrode 71) inherent to a display electrode cell row and an address electrode 10, but the discharge may also be generated between a display electrode 62 (bus electrode 72) acting as a common electrode in the main discharge and an address electrode 10. Further, in this embodiment, the structure of the display electrodes 6 and the bus electrodes 7 are made identical with that in the fourth embodiment, but the structure is not restricted only thereto and may be identical with that in the first or the third embodiment. While the barrier ribs 110 forming the discharging space on the side of the front substrate are formed by the barrier wall substrate, they may be formed directly on the front substrate 1 as in the sixth embodiment.

Embodiment 10

Figure 14A:
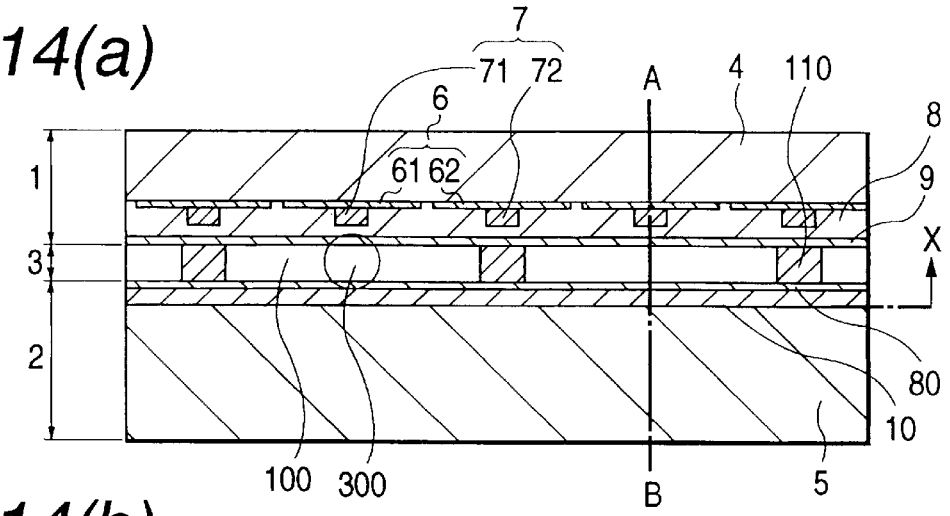
FIG. 14(*a*) is a cross sectional view of a gas discharging type display device taken in parallel with the address electrodes and illustrating a tenth embodiment according to the present invention.
Figure 14B:
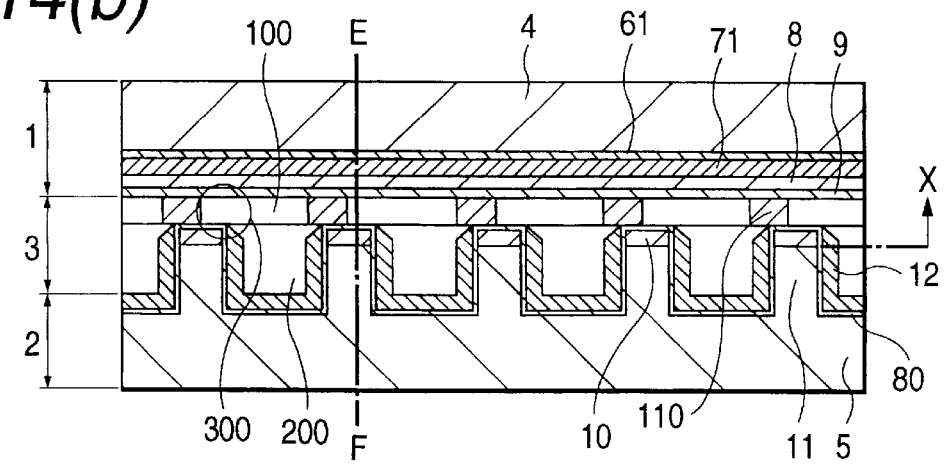
Figure 14C:
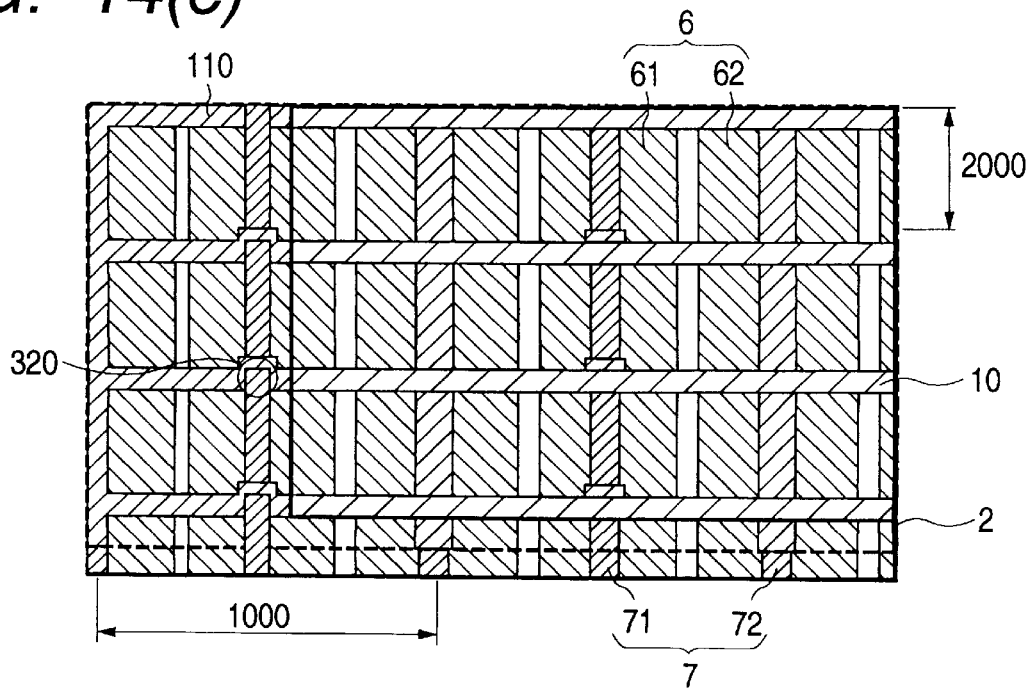

A tenth embodiment according to the present invention will be explained with reference to FIGS. 14(*a*), 14(*b*) and 14(*c*). FIG. 14(*a*) and FIG. 14(*b*) are cross sectional views of a portion of a gas discharging type display device to which the present invention is applied. FIG. 14(*a*) shows a cross section in parallel with the address electrodes, and FIG. 14(*b*) shows a cross section taken along line A-B shown in FIG. 14(*a*), which is transverse to the address electrodes. FIG. 14(*a*) illustrates a cross section taken along line E-F shown in FIG. 14(*b*). FIG. 14(*c*) is a diagrammatic view illustrating a positional relationship between the address electrodes, and the barrier ribs on the side of the front substrate, and the display electrodes and the bus electrodes disposed on the front substrate, as viewed in the direction X shown in FIG. 14(*a*) and FIG. 14(*b*). A portion in FIG. 14(*c*) surrounded with a heavy solid line is a view of the front substrate from just beneath the address electrodes 10 formed on the back substrate 2, a portion surrounded by a dotted line is a view of the front substrate from just beneath the barrier ribs 110 forming the discharging space on the side of the front substrate and the remaining portion shows the display electrodes 6 and the bus electrodes 7 disposed on the front substrate 1. While FIG. 13(*c*) is not a cross sectional view, the barrier ribs 110 on the side of the front substrate, the display electrodes 6, the bus electrodes 7 and the address electrodes 10 are hatched, and the dielectric layer 8 and the protection layer 9 formed on the front substrate 1 are not illustrated, for ease in understanding.

As can be seen from FIG. 14(*c*), this embodiment is different from the fourth embodiment in that the address discharge generated between a bus electrode 71 and an address electrode 10 is conducted by way of a space formed by the barrier rib 110 forming the discharging space on the side of the front substrate, that rounds about on the barrier rib 11 forming the discharging space 200 on the side of the back substrate. A portion showing the feature of this embodiment is depicted as 320 in FIG. 14(*c*). In this embodiment, the address discharge is conducted between a bus electrode 71 and an address electrode 10, but it may be conducted between a display electrode 61 and an address electrode 10. Except for conducting the address discharge by way of the space formed by rounding about the barrier rib 110 forming the discharging space on the side of the front substrate from above the barrier rib 11, the structural configuration, manufacturing method and applicable features of the present invention are identical with those in the fourth embodiment. Accordingly, also in this embodiment, identical effects as those in the fourth embodiment can be obtained. Further, since the width of the barrier ribs 110 and the barrier ribs 11 can be reduced in this embodiment, an effect of increasing the opening degree can be obtained. As a result, the gas discharging type display device of this embodiment can produce increased brightness on the display screen and cope with refinement.

In this embodiment, like that in the second embodiment, it is desirable to dispose a branched portion of the non-transparent bus at locations where the address electrodes 10 and the display electrodes 6 intersect. In this case, since light emission from the discharging gas produced by the address discharge is shielded, the effects of improving the contrast on the display screen and lowering the resistance of the bus electrodes 7 can be obtained in the same manner as in the second embodiment.

In the case of this embodiment, an address discharge is generated between a display electrode 61 (bus electrode 71) inherent to a display electrode cell row and an address electrode 10, but the discharge may also be generated between a display electrode 62 (bus electrode 72) acting as a common electrode in the main discharge and an address electrode 10. Further, in this embodiment, the structure of the display electrodes 6 and the bus electrodes 7 are identical with that in the fourth embodiment, but the structure is not restricted only thereto and may be identical with that in the first or the third embodiment. While the barrier ribs 110 forming the discharging space on the side of the front substrate is formed by the barrier wall substrate, they may be formed directly on the front substrate 1 as in the sixth embodiment.

Embodiment 11

Figure 15A:
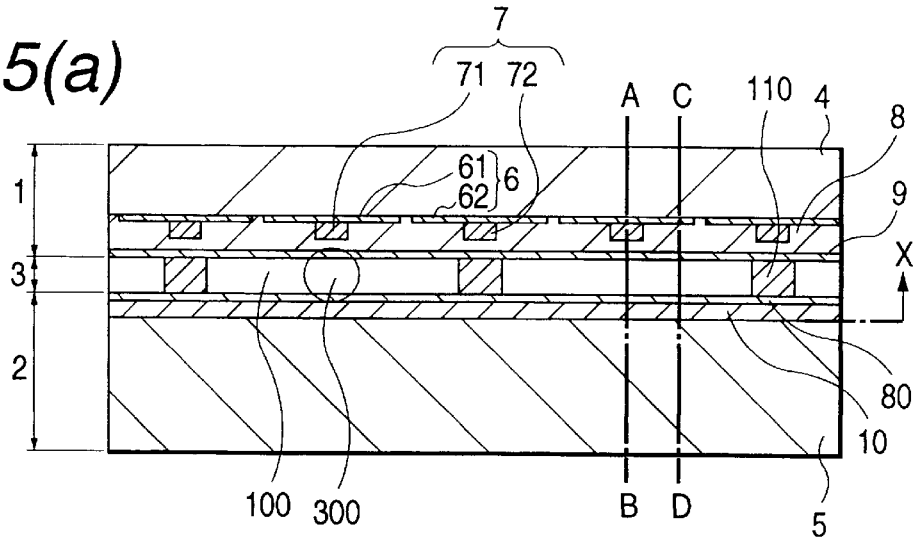
FIG. 15(*a*) is a cross sectional view of a gas discharging type display device taken in parallel with the address electrodes and illustrating an eleventh embodiment according to the present invention.
Figure 15B:
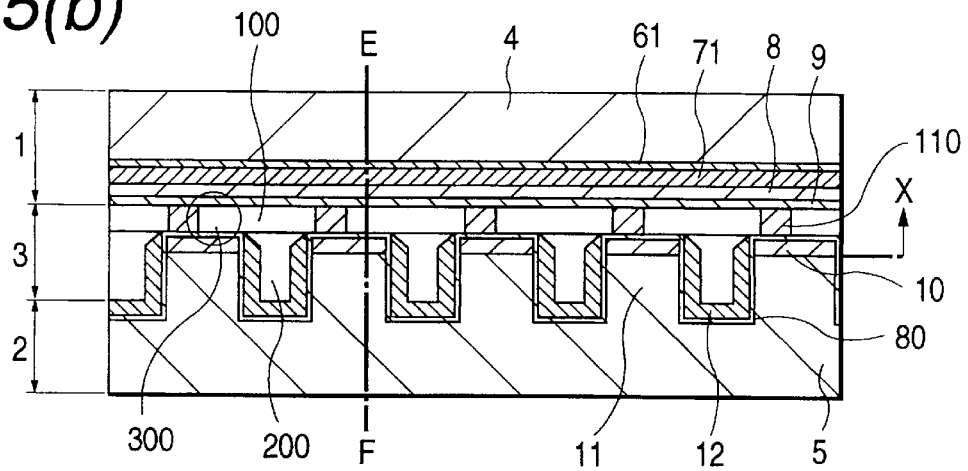
Figure 15C:
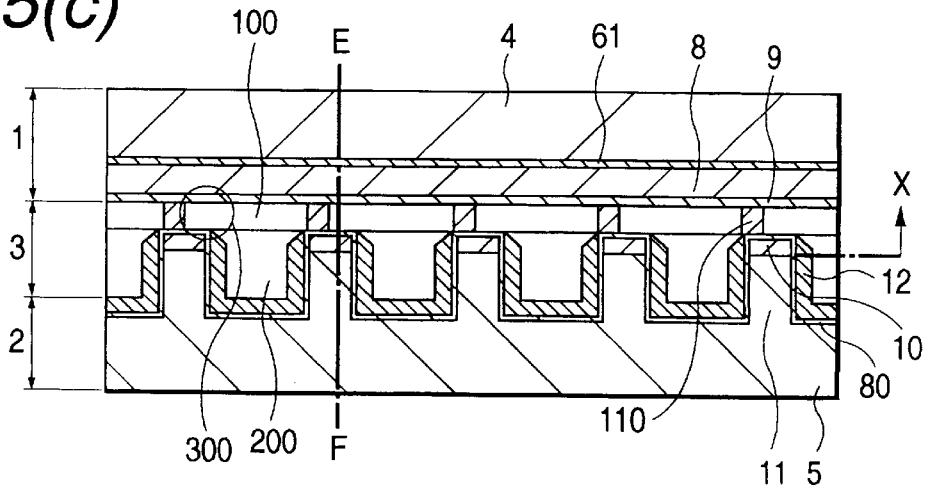

An eleventh embodiment according to the present invention will be explained with reference to FIGS. 15(*a*), 15(*b*), 15(*c*) and FIG. 16. FIGS. 15(*a*), 15(*b*) and 15(*c*) are cross sectional views of a portion of a gas discharging type display device to which the present invention is applied. FIG. 15(*a*) shows a cross section in parallel with the address electrodes, FIG. 15(*b*) shows a cross section taken along line A-B shown in FIG. 15(*a*), which is transverse to the address electrodes, and FIG. 15(*c*) shows a cross section taken along line C-D shown in FIG. 15(*a*). FIG. 15(*a*) illustrates a cross section taken along line E-F shown in FIG. 15(*b*) and FIG. 15(*c*).

Figure 16:
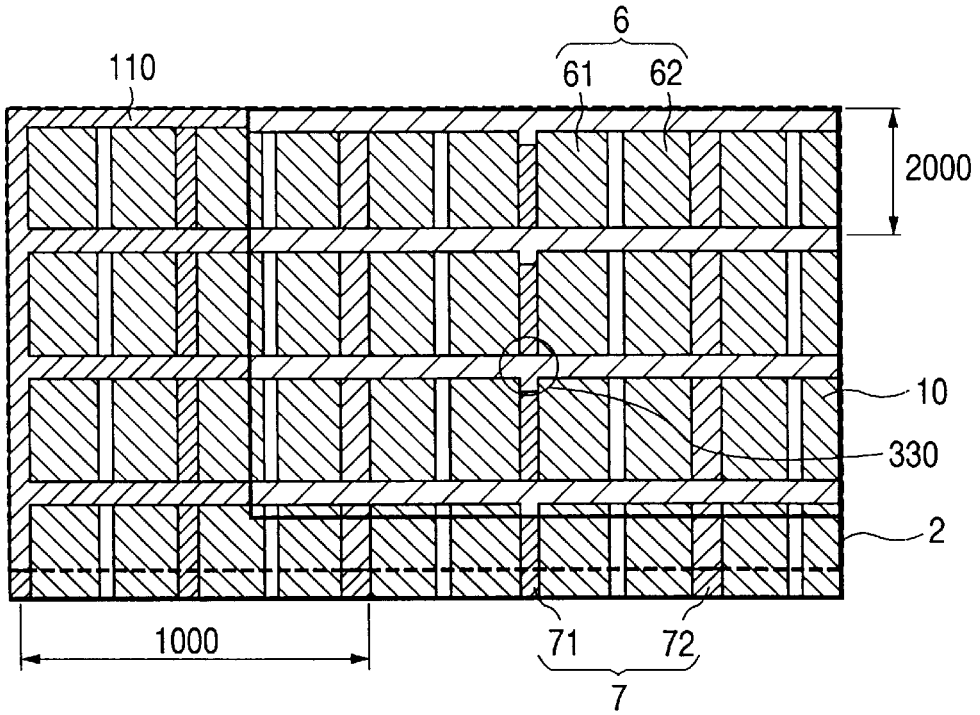
FIG. 16 is a diagrammatic view illustrating a positional relationship the between address electrodes and the barrier ribs on the side of a front substrate, and the display electrodes and the bus electrodes in the eleventh embodiment as viewed from the direction X in FIG. 15(*a*).

FIG. 16 is a diagrammatic view illustrating a positional relationship between the address electrodes, and the barrier ribs on the side of the front substrate, and the display electrodes and the bus electrodes disposed on the front substrate, as viewed in the direction X shown in FIG. 15(*a*). A portion in the figure surrounded with a heavy solid line is a view of the front substrate from just beneath the address electrodes 10 formed on the back substrate 2, a portion surrounded by a dotted line is a view of the front substrate from just beneath the barrier ribs 110 forming the discharging space 100 on the side of the front substrate and the remaining portion shows the display electrodes 6 and the bus electrodes 7 disposed on the front substrate 1. While FIG. 16 is not a cross sectional view, the barrier rib 110 forming the discharging space 200 on the side of the front substrate, the display electrodes 6, the bus electrode 7 and the address electrode 10 are hatched, and the dielectric layer 8 and the protection layer 9 formed on the front substrate 1 are not illustrated, for ease in understanding.

As can be seen from FIG. 15(*a*) and FIG. 16, this embodiment is different from the fourth embodiment in that a branched portion is disposed on one side of the address electrodes 10 so sa to extend toward the main discharging space 100 at those locations where the bus electrode 71 on the display electrode 61, acting as an electrode inherent to the display electrode cell row in the main discharge, and the address electrodes 10 intersect. In this case, since the address electrodes 10 are formed on the barrier ribs 11, the barrier ribs also protrude in the discharging space 200 on the side of the back substrate. A portion showing the feature of this embodiment is depicted by 330 in FIG. 16. In this embodiment, an address discharging is conducted between a bus electrode 71 and an address electrode 10 but it may be conducted between the display electrode 61 and the address electrode 10. This embodiment provides a structure for a gas discharging type display device which is effective in narrowing the width of the barrier ribs 11 and the barrier ribs 110 for the purpose of coping with an increase in the opening degree to enhance the brightness or attain refinement. In this embodiment, an address discharge is generated between the branched portion of an address electrode 10 protruded in the main discharging space 100 and a bus electrode 71. Except for the protrusion of the address electrodes 10 into the main discharging space 100 described above, the structural arrangement, manufacturing method and applicable features of the present invention are identical with those in the fourth embodiment. Accordingly, the same effects as those in the fourth embodiment can be obtained in this embodiment in addition to the effects described above.

Also in this embodiment, like that in the second embodiment, it is desirable to dispose a branched portion of the non-transparent bus electrode having a low resistance at locations where the address electrodes 10 and the display electrodes 6 intersect. In this case, since light emission from the discharging gas produced by the address discharge is shielded, the effects of improving the contrast on the display screen and lowering the resistance of the bus electrodes 7 can be obtained in the same manner as in the second embodiment.

In this embodiment, the structure of the display electrodes 6 and the bus electrodes 7 are identical with that in the fourth embodiment, but the structure is not limited thereto and may be made to correspond with that in the first or third embodiment. Further, while the barrier ribs 110 forming the discharging space on the side of the front substrate are formed by the barrier wall substrate, they may be formed directly on the front substrate 1 as in the sixth embodiment.

Embodiment 12

Figure 17A:
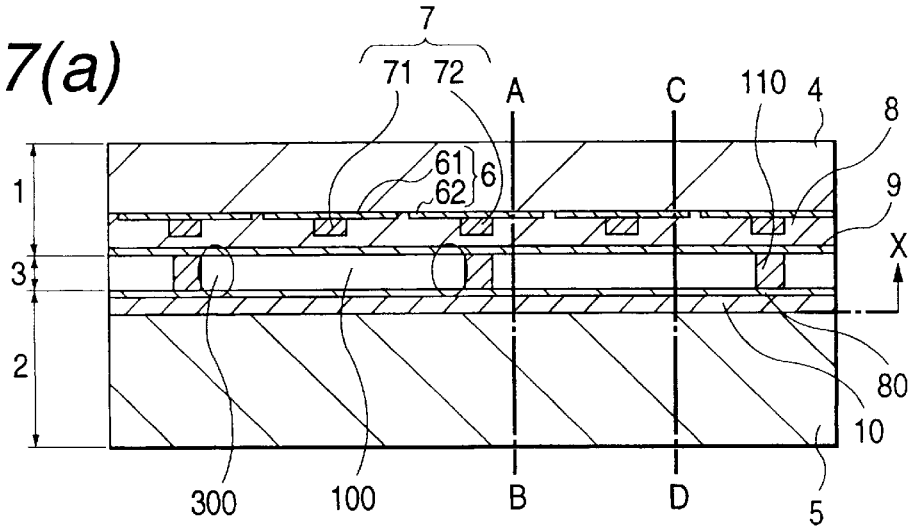
FIG. 17(*a*) is a cross sectional view of a gas discharging type display device taken in parallel with the address electrodes and illustrating a twelfth embodiment according to the present invention.
Figure 17B:
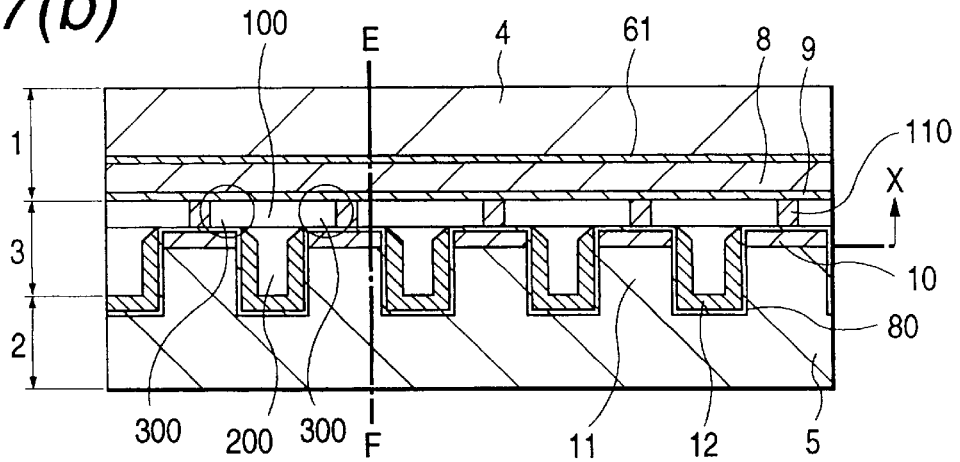
Figure 17C:
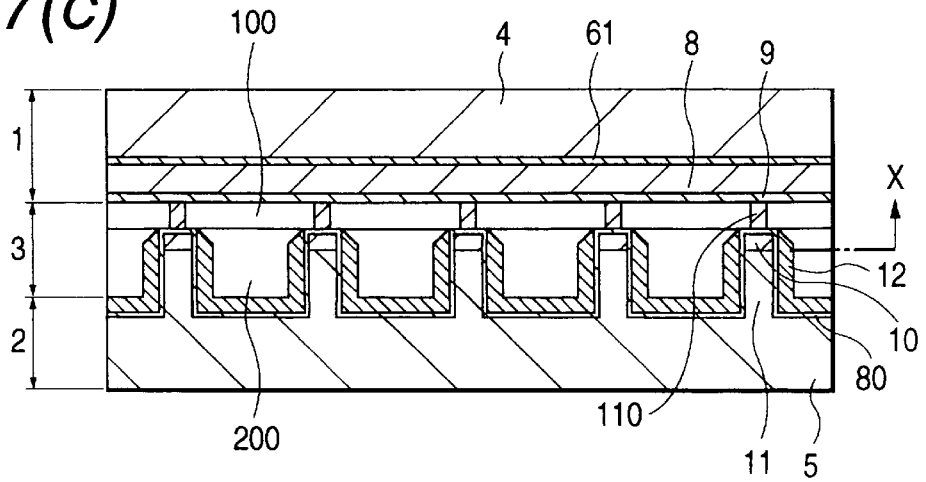

An eleventh embodiment according to the present invention will be explained with reference to FIGS. 17(*a*), 17(*b*), 17(*c*) and FIG. 18. FIGS. 17(*a*), 17(*b*) and 17(*c*) are cross sectional views of a portion of a gas discharging type display device to which the present invention is applied. FIG. 15(*a*) shows a cross section in parallel with the address electrodes, and FIG. 15(*b*) shows a cross section taken along line A-B shown in FIG. 15(*a*), which is transverse to the address electrodes, and FIG. 15(*c*) shows a cross section taken along line C-D shown in FIG. 15(*a*), which is transverse to the address electrodes. FIG. 15(*a*) illustrates a cross section taken along line E-F shown in FIG. 15(*b*) and FIG. 15(*c*).

Figure 18A:
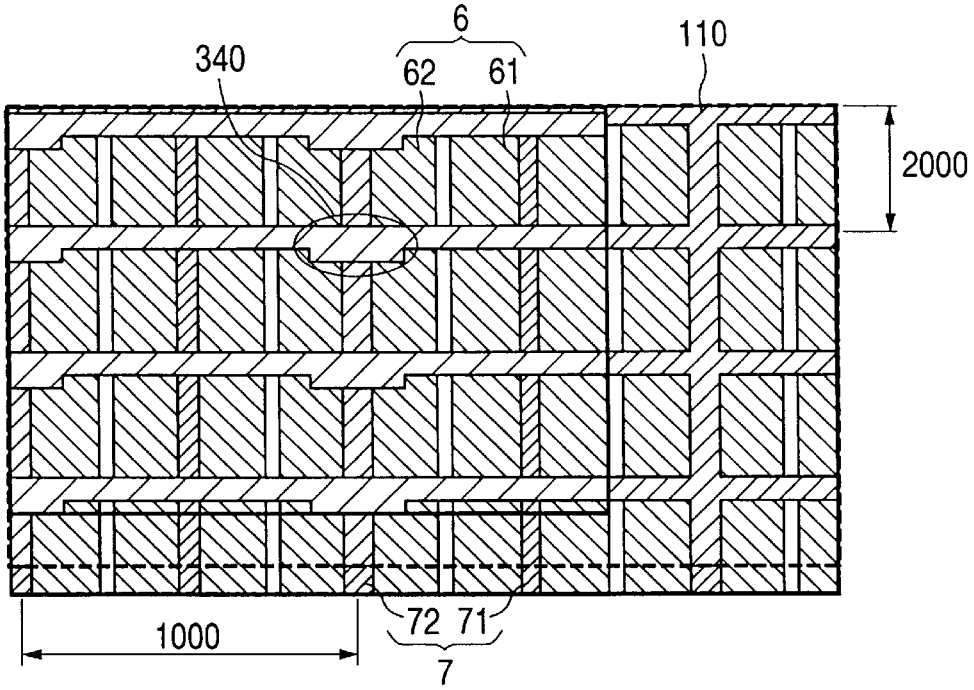
FIG. 18(*a*) is a diagrammatic view illustrating a positional relationship between the address electrodes and the barrier ribs on the side of a front substrate, and the display electrodes and the bus electrodes in the twelfth embodiment as viewed from the direction X in FIG. 17(*a*).
Figure 18B:
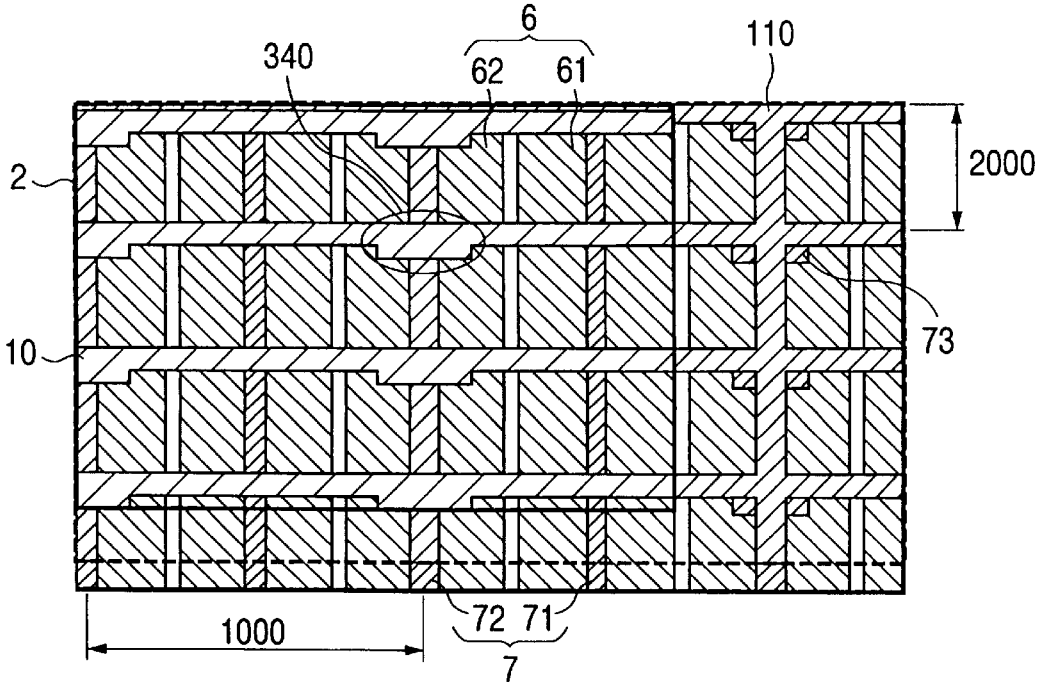

FIG. 18(*a*) is a diagrammatic view illustrating a positional relationship between the address electrodes, and the barrier ribs on the side of the front substrate, and the display electrodes and the bus electrodes disposed on the front substrate, as viewed in the direction X shown in FIG. 17(*a*). A portion in the figure, surrounded with a heavy solid line is a view of the front substrate side from just beneath the address electrodes 10 formed on the back substrate 2, a portion surrounded by a dotted line is a view of the front substrate from just beneath the barrier ribs 110 on the side of the front substrate for forming the discharging space 100 and the remaining portion shows the display electrodes 6 and the bus electrodes 7 disposed on the front substrate 1. FIG. 18(*a*) is not a cross sectional view, but for clear understanding, the barrier ribs 110 on the side of the front substrate, the display electrodes 6, the bus electrodes 7 and the address electrodes 10 are hatched, and the dielectric layer 8 and the protection layer 9 formed on the front substrate are not illustrated.

As can be seen from FIGS. 17(*a*), 17(*b*) and FIG. 18(*a*), this embodiment is different from the fourth embodiment in that a branched portion is disposed on one side of the address electrodes 10 which protrudes toward the main discharging space 100 at locations where the display electrodes 62, acting as a common electrode in the main discharge for display, and the address electrodes 10 intersect. In this case, since the address electrodes 10 are formed on the barrier ribs 11, the barrier ribs 11 also protrude in the discharging space 200. A portion showing the feature of this embodiment is depicted by 340 in FIG. 18(*a*). This embodiment can provide a structure for a gas discharging type display device which is effective in narrowing the width of the barrier ribs 11 and the barrier ribs 110 for the purpose of coping with an increase in the opening degree to enhance the brightness or attain refinement. This is because the address discharging space can be ensured even if the width of the barrier ribs 11 forming the address electrodes 10 is narrowed. In this embodiment, an address discharge is generated between the branched portion of the address electrodes 10 protruding into the main discharging space 100 and the display electrodes 62, to select an address electrode cell row. Except for the protrusion of the address electrodes 10 into the main discharging space 100 as described above, the structural arrangement, manufacturing method and applicable features of the present invention are identical with those in the fourth embodiment. Accordingly, the same effects as those in the fourth embodiment can be obtained in this embodiment in addition to the effect described above.

Also in this embodiment, as shown in FIG. 18(*b*), it is desirable to dispose a branched portion of the non-transparent bus electrodes 72 having a low resistance at locations where the address electrodes 10 and the display electrodes 62 intersect. In this case, since light emission from the discharging gas produced by the address discharge is shielded, the effects of improving the contrast on the display screen and lowering the resistance of the bus electrode 7 can be obtained in the same manner as in the second embodiment.

Further, in this embodiment, the structure of the display electrodes 6 and the bus electrodes 7 are identical with that in the fourth embodiment, but the structure is not restricted only thereto and may be identical with that in the first or the third embodiment. While the barrier ribs 110 forming the discharging space on the side of the front substrate are formed by the barrier wall substrate, they may be formed directly on the front substrate 1 in the same manner as the sixth embodiment.

Embodiment 13

Figure 19A:
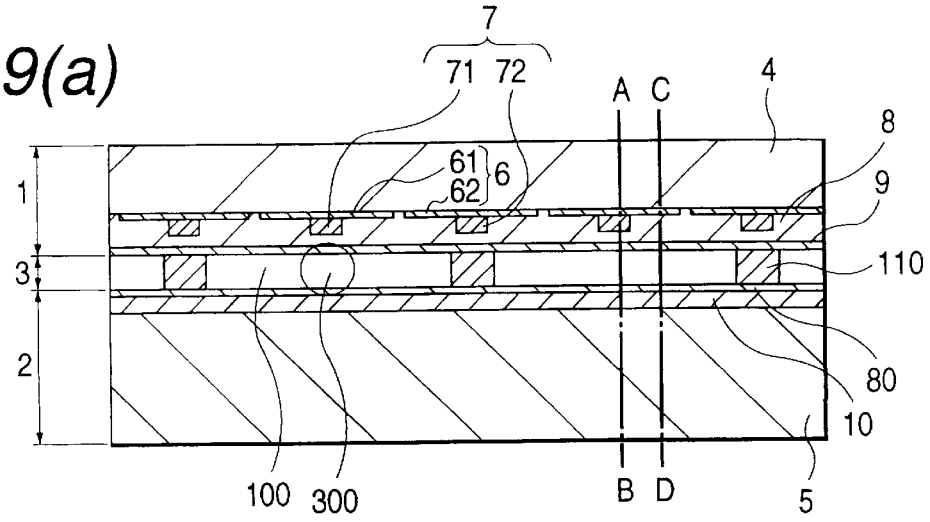
FIG. 19(*a*) is a cross sectional view of a gas discharging type display device taken in parallel with the address electrodes and illustrating a thirteenth embodiment according to the present invention.
Figure 19B:
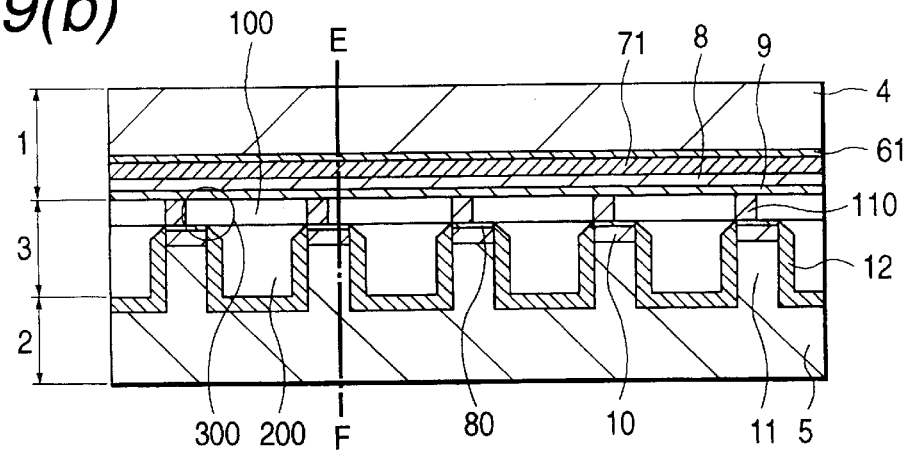
Figure 19C:
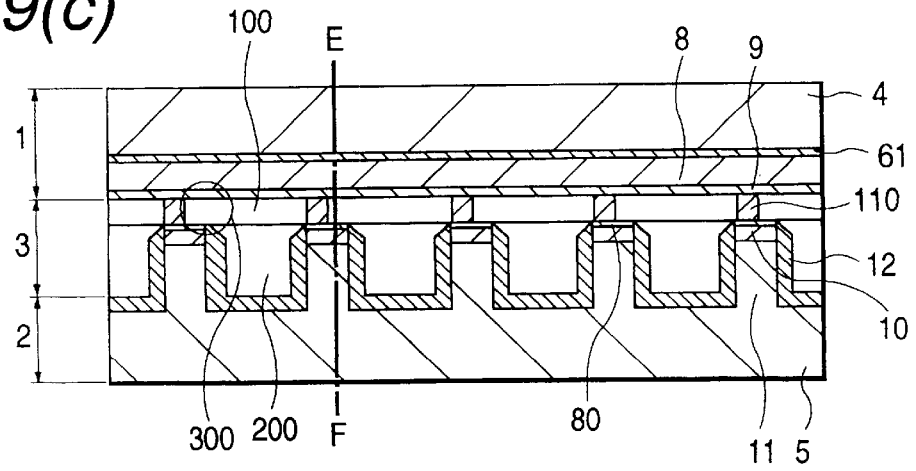

A thirteenth embodiment according to the present invention will be explained with reference to FIGS. 19(*a*), 19(*b*) and 19(*c*), which are cross sectional views of a portion of a gas discharging type display device to which the present invention is applied. FIG. 19(*a*) shows a cross section in parallel with the address electrodes, FIG. 19(*b*) shows a cross section taken along line A-B shown in FIG. 19(*a*), which is transverse to the address electrodes, and FIG. 19(*c*) shows a cross section taken along line C-D shown in FIG. 19(*a*), which is transverse to the address electrodes. FIG. 19(*a*) illustrates a cross section taken along line E-F shown in FIG. 19(*b*) and FIG. 19(*c*).

As can be seen from FIG. 19(*a*), this embodiment is different from the fourth embodiment in that the insulator layer 80 is formed only on the upper surface of the address electrodes 10 formed on the barrier ribs 11 forming the discharging space 200 on the side of the back substrate, and in that the address electrodes 10 and the barriers rib 11 are formed after forming the insulator layer 80 on the conductor layer. This embodiment intends to improve the quality, for example, by eliminating defects, such as pinholes, in the insulator layer 80 covering the address electrodes 10, and to enhance the current restricting performance in the address discharge. The structural arrangement and applicable features of the present invention are otherwise identical with those in the fourth embodiment.

Since this embodiment is different from the first embodiment with regard to its manufacturing method, one example of the manufacturing method for the back substrate 2 in this embodiment will be explained with reference to FIG. 26.

(1) A back glass substrate 5 comprising, for example, soda lime glass is cleaned by using, for example, a neutral detergent.

(2) A Cr/Cu/Cr laminate film is formed as a conductor layer for the film on the cleaned back glass substrate 5 by using a film forming method, for example, sputtering or electron beam vapor deposition.

(3) A hydrolyzable coating agent mainly composed of Al, Si and O (alkoxide, etc.) is coated, for example, by blading or spraying on a predetermined area of the back glass substrate 5 on which the conductor layer is formed and the coating is heated at a temperature of 100 to 400° C. for 1 to 60 min, thereby forming an insulator layer 80 of 0.002 to 0.05 mm.

(4) A predetermined pattern is formed by using a light sensitive film on the back glass substrate 5 on which insulator layer 80 is formed. Then, sand blasting is applied to engrave a portion of the back glass substrate 5, not covered with the light sensitive film, to form the barrier ribs 11 partitioning the discharging space 200 on the side of the back substrate. Then, the light sensitive film is removed by a well-known method using, for example, sodium hydroxide.

(5) A fluorescent layer 12 is coated on the inner wall of the barrier ribs 11 forming the discharging space 200 on the side of the back substrate, for example, by spraying or blading. In a case of a gas discharging display device for a color display, fluorescent layers 12 emitting colors of green, blue and red are coated by aligning masks of predetermined patterns for green, blue and red. Then, a heat treatment is applied at a temperature from 150 to 300° C. for 5 to 60 min.

(6) A pattern of frit glass is formed by using, for example, a thick-film printing method, and the result is dried to form a seal layer (not illustrated) for vacuum sealing.

By the steps described above, the back substrate 2 having the barrier ribs 11 partitioning the discharging space 200 on the side of the back substrate is completed. The back substrate 2 is provided with a tip tube (not illustrated) for exhaustion and gas introduction after panel assembling.

The back substrate 2, prepared by the steps described above, and the front substrate 1, prepared in the same manner as in the first embodiment, are assembled while aligning with the partition wall substrate 90, and a heat treatment is applied at 300 to 450° C. to fix these substrates. Then, the discharging space 3 defined between the front substrate 1 and the back substrate 2 is evacuated through the tip tube (not illustrated) disposed in the back substrate and, for example, Ne containing 3% Xe is introduced into the main discharging space 100 put between the front substrate 1 and the back substrate 2, and the pressure in the discharging space 3 is adjusted to 35–70 kPa. Then, the tip tube (not illustrated) is locally heated to seal it off, to complete the gas discharging type display device shown in FIG. 19(*a*).

This embodiment is different from the fourth embodiment in that the insulator layer 80 is formed only on the upper surface of the address electrode 10 and in the manufacturing method of the back substrate 2, and the other structure features of the present invention are identical with those in the fourth embodiment. Therefore, this embodiment can provide identical effects with those in the fourth embodiment.

Also in this embodiment, like that in the second embodiment, it is desirable to dispose a branched portion 73 of the non-transparent bus electrodes having a low resistance at locations where the address electrodes 10 and the display electrodes 6 intersect. In this case, the effects of improving the contrast on the display screen and lowering the resistance of the bus electrodes 7 can be obtained in the same manner as in the second embodiment.

Further, in this embodiment, an address discharge is generated between a display electrode 61 (bus electrode 71) inherent to a display electrode cell row and an address electrode 10, but the discharge may be generated between a display electrode 62 (bus electrode 72) acting as a common electrode in the main discharge and an address electrode 10.

Further, the structure of the display electrodes 6 and the bus electrodes 7 are identical with that in the fourth embodiment, but the structure is not restricted only thereto and may be identical with that in the first or the third embodiment. In this case, the effect obtained in the first and the third embodiment can be obtained.

In this embodiment, the barrier ribs 110 partitioning the main discharging space 100 on each display cell are formed with the barrier wall substrate 90. However, the method of forming the barrier ribs 110 is not restricted thereto, and they may be formed directly on the front substrate 2 in the same manner as in the sixth embodiment.

Further, the insulator layer 80 on the address electrodes 10 is formed by using a hydrolyzable coating agent in this embodiment, but the material for the insulator layer 80 is not limited only thereto. Further, the method of forming the insulator layer 80 is not restricted to the combination of blading or spraying and heat setting used in this embodiment, but sputtering, vacuum vapor deposition, such as electron beam vapor deposition, chemical vapor phase deposition or thick-film printing or the like may be used. Further, if the consumption by the discharge of the insulator layer 80 is violent, it is desirable to form the insulator layer 80 with a material of excellent sputtering resistance relative to the discharging gas, for example, MgO.

Further, it is also effective for improving the reliability of the address electrodes 10 to form a further insulator layer after forming the barrier ribs 11, thereby compensating for defects in the insulator layer 80.

Embodiment 14

Figure 20A:
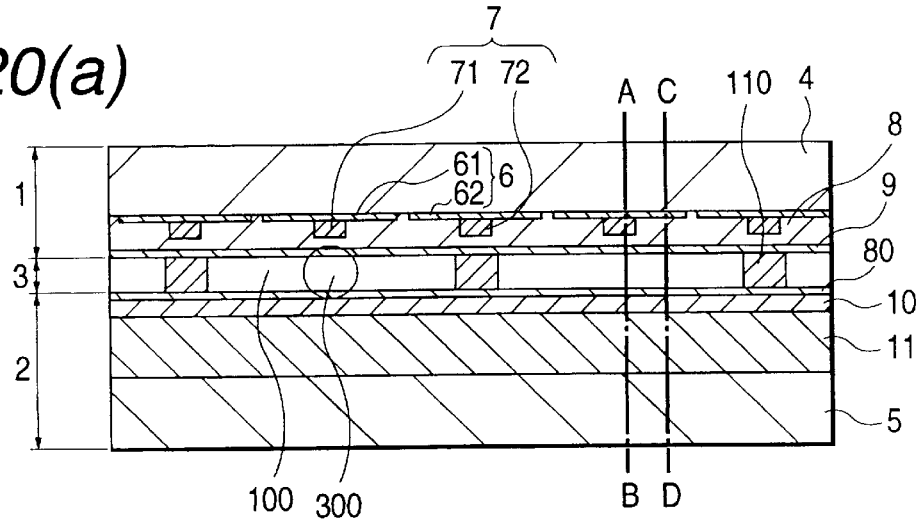
FIG. 20(*a*) is a cross sectional view of a gas discharging type display device taken in parallel with the address electrodes and illustrating a fourteenth embodiment according to the present invention.
Figure 20B:
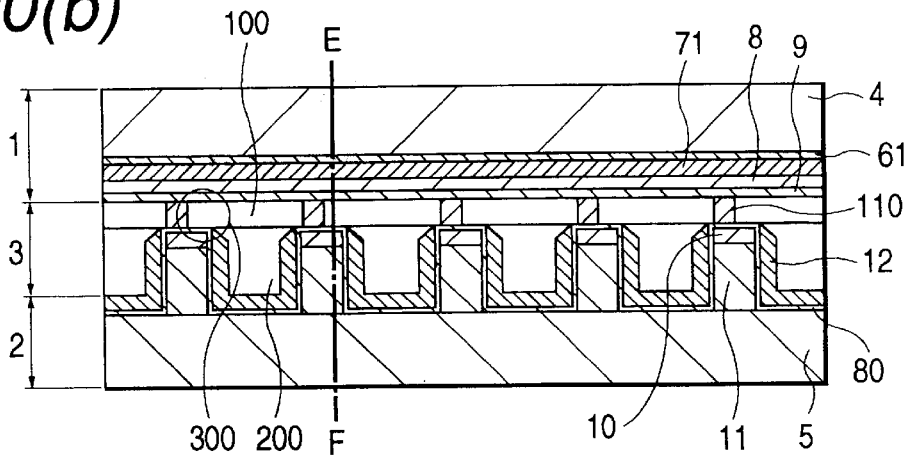
Figure 20C:
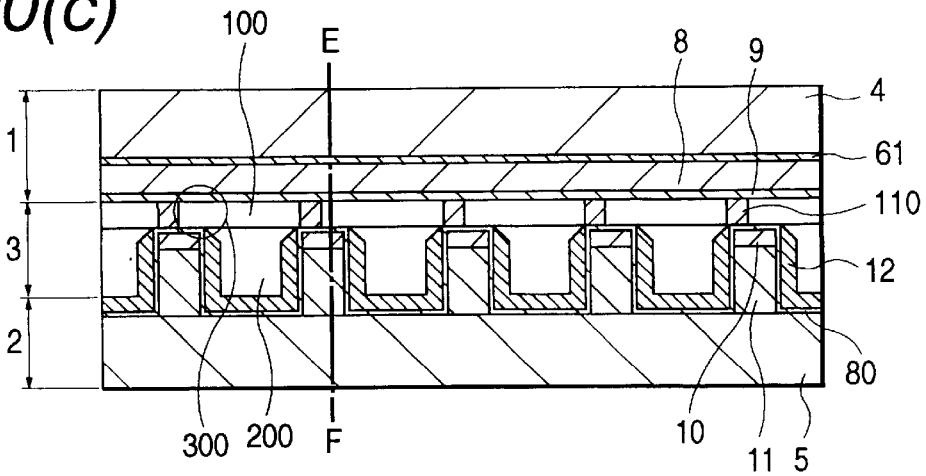

A fourteenth embodiment according to the present invention will be explained with reference to FIGS. 20(*a*), 20(*b*) and 20(*c*), which are cross sectional views of a portion of a gas discharging type display device to which the present invention is applied. FIG. 20(*a*) shows a cross section in parallel with the address electrodes, FIG. 20(*b*) shows a cross section taken along line A-B shown in FIG. 20(*a*), which is transverse to the address electrodes, and FIG. 20(*c*) shows a cross section taken along line C-D shown in FIG. 20(*a*), which is transverse to the address electrodes. FIG. 20(*a*) illustrates a cross section taken along line E-F shown in FIG. 20(*b*) and FIG. 20(*c*).

This embodiment is different from the fourth embodiment in that the barrier rib 11 forming the discharging space 200 on the side of the back substrate is formed of the material different from the back glass substrate 5. The structural arrangement and the applicable features of the present invention are otherwise identical with those in the fourth embodiment.

Since this embodiment is different from the first embodiment in view of the structure of the back substrate 2, one example of the manufacturing method for the back substrate 2 in this embodiment will be explained with reference to FIG. 26.

(1) A back glass substrate 5 comprising, for example, soda lime glass is cleaned by using, for example, a neutral detergent.

(2) A film of a barrier rib material is formed on the cleaned back glass substrate 5 by using a method, for example, of thick-film printing, is dried and then baked to form a barrier rib layer.

(3) A Cr/Cu/Cr laminate film is formed as a conductor layer on the cleaned back glass substrate 5 on which the barrier rib layer is formed by using a film forming method, for example, sputtering or electron beam vapor deposition.

(4) A predetermined pattern is formed by using a light sensitive film on the back glass substrate 5 on which the conductor layer is formed. Then, sand blasting is applied to engrave a portion of the back glass substrate 5 not covered with the light sensitive film, to form the barrier ribs 11 forming the discharging space 200 on the side of the back substrate and the addressing electrodes. Then, the light sensitive film is removed by a well-known method using, for example, sodium hydroxide.

(5) A hydrolyzable coating agent mainly composed of Al, Si and O (alkoxide, etc.) is coated, for example, by blading or spraying on a predetermined area of the back glass substrate 5 on which the barrier ribs 11 and the address electrodes 10 are formed, and the result is heated at a temperature of 100 to 400° C. for 1 to 60 min, thereby forming an insulator layer 80 of 0.002 to 0.05 mm.

(6) A fluorescent layer 12 is coated on the inner wall of the barrier rib 11 forming the discharging space 200 on the side of the back substrate, for example, by spraying or blading. In the case of a gas discharging display device for a color display, fluorescent layers 12 emitting colors of green, blue and red are coated by aligning masks of predetermined patterns for green, blue and red. Then, a heat treatment is applied at a temperature from 150 to 300° C. for 5 to 60 min.

(7) A pattern of frit glass is formed by using, for example, a thick-film printing method, and the result is dried to form a seal layer (not illustrated) for vacuum sealing.

By the steps described above, the back substrate 2 having barrier ribs 11 partitioning the discharging space 200 on the side of the back substrate is completed. The back substrate 2 is provided with a tip tube (not illustrated) for exhaustion and gas introduction after panel assembling.

The back substrate 2 prepared by the steps described above, and the front substrate 1, prepared in the same manner as the first embodiment, are assembled while aligning with a partition wall substrate, and heat treatment is applied at 300 to 450° C. to fix these substrates. Then, the discharging space 3 defined between the front substrate 1 and the back substrate 2 is evacuated through the tip tube (not illustrated) disposed in the back substrate and, for example, Ne containing 3% Xe is introduced into the discharging space put between the front substrate 1 and the back substrate 2, and the pressure in the discharging space 3 is adjusted to 35–70 kPa. Then, the tip tube (not illustrated) is locally heated to seal it off, to complete the gas discharging type display device shown in FIG. 20(*a*).

This embodiment is different from the fourth embodiment only in that the barrier rib 11 is made of a material other than that of the back glass substrate 5, but the manufacturing steps after forming the barrier rib material and the place to which the present invention is applied are identical with those in the fourth embodiment. Therefore, this embodiment can provide the identical effects with those in the fourth embodiment. There is little damage to the front glass substrate, therefore this embodiment can provide an effect of improving the mechanical strength of the back substrate 2. Further, since the density of the barrier rib material is usually lower than that of the back glass substrate 5, an effect of moderating the sand blast condition or the like can also be obtained.

Also in this embodiment, like that in the second embodiment, it is desirable to dispose a branched portion 73 of the non-transparent bus electrodes having a low resistance at a place where the address electrodes 10 and the display electrodes 6 intersect. In this case, the effects of improving the contrast on the display screen and lowering the resistance of the bus electrodes 7 can be obtained in the same manner as in the second embodiment.

Further, in this embodiment, an address discharge is generated between a display electrode 61 (bus electrode 71) inherent to a display electrode cell row and an address electrode 10, but the discharge may be generated between a display electrode 62 (bus electrode 72) acting as a common electrode in the main discharge and an address electrode 10.

Further, the structure of the display electrodes 6 and the bus electrodes 7 are made identical with that in the fourth embodiment, but the structure is not restricted only thereto and may be identical with that in the first or the third embodiment. In this case, the effect obtained in the first and the third embodiment can be obtained.

In this embodiment, the barrier ribs 110 partitioning the main discharging space 100 on each display cell are formed by the barrier wall substrate 90. However, the method of forming the barrier ribs 110 is not restricted thereto, and they may be formed directly on the front substrate 2 as in the sixth embodiment.

Further, the insulator layer 80 on the address electrodes 10 is formed by using a hydrolyzable coating agent in this embodiment, but the material for the insulator layer 80 is not limited only thereto. Further, the method of forming the insulator layer 80 is not restricted to the combination of blading or spraying and heat setting used in this embodiment, but sputtering, vacuum vapor deposition, such as electron beam vapor deposition, chemical vapor phase deposition or thick-film printing or the like may be used. Further, if the consumption by the discharge of the insulator layer 80 is violent, it is desirable to form the insulator layer 80 with a material of excellent sputtering resistance relative to the discharging gas, for example, MgO.

Embodiment 15

Figure 21A:
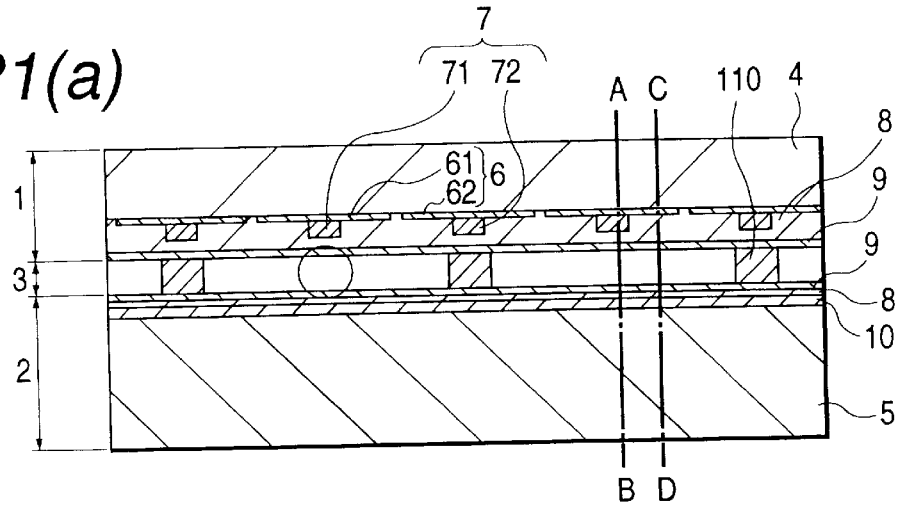
FIG. 21(*a*) is a cross sectional view of a gas discharging type display device taken in parallel with the address electrodes and illustrating a fifteenth embodiment according to the present invention.
Figure 21B:
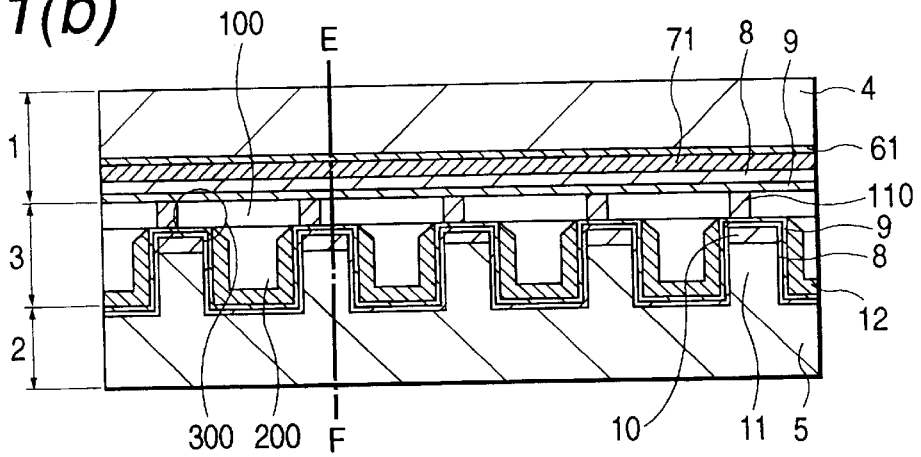
Figure 21C:
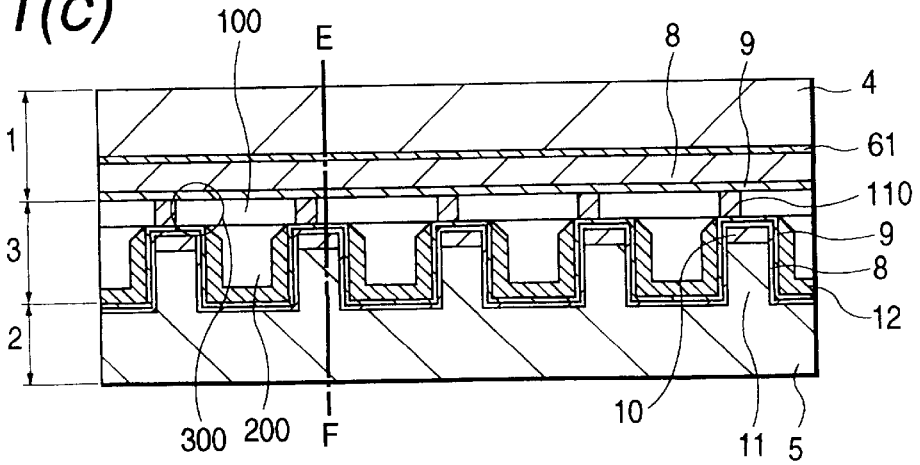

A fifteenth embodiment according to the present invention will be explained with reference to FIGS. 21(*a*), 21(*b*) and 21(*c*), which are sectional views of a portion of a gas discharging type display device to which the present invention is applied. FIG. 21(*a*) shows a cross section in parallel with the address electrodes, FIG. 21(*b*) shows a cross section taken along line A-B shown in FIG. 21(*a*), which is transverse to the address electrodes, and FIG. 21(*c*) shows a cross section taken along line C-D shown in FIG. 21(*a*), which is transverse to the address electrodes. FIG. 21(*a*) illustrates a cross section taken along line E-F shown in FIG. 21(*b*) and FIG. 21(*c*).

As can be seen from FIG. 21, this embodiment is different from the fourth embodiment in that the insulator layer 80 covering the address electrodes 10 formed on the barrier ribs 11 for forming the discharging space 200 on the side of the back substrate is constituted by a stacked film of the dielectric layer 8 and the protection layer 9 made of MgO or the like. The other structural arrangements and the applicable features of the present invention are identical with those in the fourth embodiment. Accordingly, in this embodiment, the same effects as those in the fourth embodiment can be obtained. Further, since the address electrodes 10 are covered with the dielectric layer 8 and the protection layer 9 in this embodiment, the effects of increasing the working life of the address electrodes 10 and keeping the address discharge stably can be attained. The effects can be obtained also in the first to third and fifth to fourteenth embodiments by replacing the insulation layer 80 with the stacked film of the dielectric layer 8 and the protection layer 9.

Also in this embodiment, like that in the second embodiment, it is desirable to dispose a branched portion 73 of the non-transparent bus electrodes having a low resistance at a place where the address electrodes 10 and the display electrodes 6 intersect. In this case, the effects of improving the contrast in an image on the display screen and the lowering of the resistance of the bus electrodes 7 can be obtained in the same manner as in the second embodiment.

Further, in this embodiment, an address discharge is generated between a display electrode 61 (bus electrode 71) inherent to a display electrode cell row and an address electrode 10, but the discharge may be generated between a display electrode 62 (bus electrode 72) acting as a common electrode in the main discharge and an address electrode 10.

Embodiment 16

Figure 27:
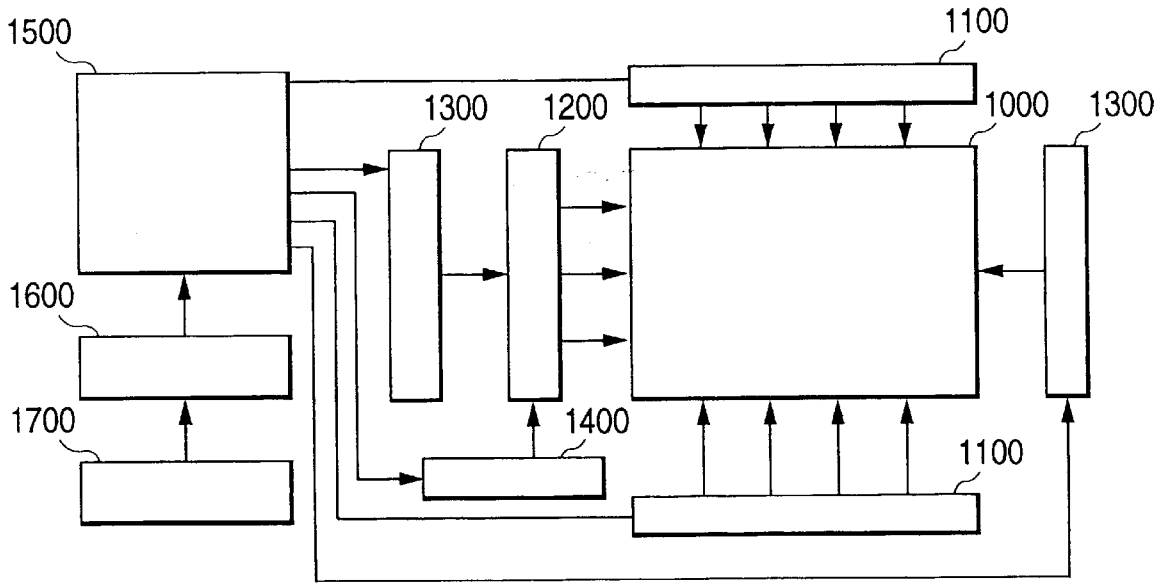
FIG. 27 is a block diagram illustrating an example of the application of the gas discharging type display panel according to the present invention to a display device.

FIG. 27 shows an example of the application the gas discharging type display panel explained above according to the present invention to a display device.

The display device includes a gas discharging type display panel 1000 of the present invention, as explained above, an address driver 1100, a scan driver 1200, a pulse generator 1300, a level shifter 1400, a control circuit 1500, an autopower control circuit 1600 and a DC/DC converter 1700. In this device, the display cell is selected by the address driver 1100 and the scan driver 1200, and a main discharge for the display is generated by a voltage generated from the pulse generator 1300. They are controlled by the control circuit 1500. Transfer of control signals from the control circuit 1500 to the scan driver 1200 is conducted by way of the level shifter 1400. The autopower control circuit 1600 is adapted to detect a high voltage power source current and send a signal for reducing the number of discharge maintaining pulses to the control circuit 1500 if a detected current exceeds a predetermined value. The DC/DC converter 1700 generates an internal voltage for the driving circuit from the voltage supplied from an external circuit.

When the gas discharging type display panel of the present invention is connected in this way to the driving circuit, a desired display can be attained even if the address voltage is set low.

In particular, since an auxiliary discharge is not necessary or is conducted only for a short period of time, a screen display at a higher efficiency compared with the prior art can be attained. Further, since erroneous light emission of the fluorescent body, for example, upon address discharge, can be suppressed, the contrast of an image on the display screen can also be improved. Further, degradation of the fluorescent body by ion damage can also be suppressed.

As described above, the present invention can provide a gas discharging type display panel and a display device using a lowered address voltage.

Further, the present invention can provide a gas discharging type display panel and a display device which does not require an auxiliary discharge or generates an auxiliary discharge only for a short period of time.

Further, the present invention can provide a gas discharging type display panel and a display device having high contrast display screen, which is capable of suppressing ion damage on the fluorescent body.

Further, the present invention can provide a gas discharging type display panel and a display device which is capable of being produced by a simplified manufacturing process.

What is claimed is:

1. A gas discharging type display device comprising a first substrate having display electrodes for generating a main discharge and first barrier ribs forming a discharging space of a display cell, and a second substrate having second barrier ribs and address electrodes disposed on the second barrier ribs so as to intersect with the display electrodes of the first substrate.

2. A gas discharging type display panel as defined in claim 1, wherein a fluorescent body is disposed on a wall surface of the second barrier ribs.

3. A gas discharging type display panel as defined in claim 2, wherein the second barrier ribs are formed with a portion of an insulating substrate constituting the second substrate.

4. A gas discharging type display panel as defined in claim 3, wherein the first barrier ribs and the second barrier ribs are aligned to overlap with each other and the width of the first barrier ribs is made narrower than the width of the second barrier ribs.

5. A gas discharging type display panel as defined in claim 4, wherein the first barrier ribs are formed in a lattice-like shape.

6. A gas discharging type display panel as defined in claim 5, wherein the first barrier ribs are formed with a substrate having openings disposed therein.

7. A gas discharging display panel comprising:

a first substrate having display electrodes; and a second substrate having barrier ribs and address electrodes disposed on the barrier ribs so as to intersect with the display electrodes of the first substrate.

8. A gas discharging type display panel as defined in claim 7, wherein a fluorescent body is disposed on a wall surface of the barrier ribs.

9. A gas discharging type display panel as defined in claim 8, wherein the barrier ribs are formed with a portion of an insulating substrate constituting the second substrate.

10. A gas discharging type display device comprising:

a gas discharging type display panel comprising a first substrate having display electrodes for generating a main discharge and first barrier ribs forming a discharging space of a display cell, and a second substrate having second barrier ribs and address electrodes disposed on the second barrier ribs so as to intersect with the display electrodes of the first substrate; and a driving circuit for supplying a predetermined driving voltage to an address electrode or a display electrode.

11. A display device as defined in claim 10, wherein a fluorescent body is disposed on a wall surface of the second barrier ribs.

12. A gas discharging type display panel as defined in claim 11, wherein the second barrier ribs are formed with a portion of an insulating substrate constituting the second substrate.

13. A gas discharging type display panel as defined in claim 12, wherein the first barrier ribs and the second barrier ribs are aligned to overlap with each other and the width of the first barrier ribs is made narrower than the width of the second barrier ribs.

14. A gas discharging type display panel as defined in claim 13, wherein the first barrier ribs are formed in a lattice shape.

15. A gas discharging type display panel as defined in claim 14, wherein the first barrier ribs are formed with a substrate having desired openings disposed therein.

16. A gas discharging type display device comprising:

a gas discharging type display panel comprising a first substrate having display electrodes, and a second substrate having barrier ribs and address electrodes disposed on the barrier ribs so as to intersect with the display electrodes of the first substrate; and a driving circuit for supplying a predetermined driving voltage to at least one of an address electrode and a display electrode.

17. A gas discharging type display device as defined in claim 16, wherein a fluorescent body is disposed on a wall surface of the barrier ribs.

18. A gas discharging type display device as defined in claim 17, wherein the barrier ribs are formed with a portion of an insulating substrate constituting the second substrate.

* * * * *